US011072958B2

(12) United States Patent
Kuramochi et al.

(10) Patent No.: US 11,072,958 B2
(45) Date of Patent: Jul. 27, 2021

(54) DAMPER HINGE AND WESTERN-STYLE TOILET USING THE SAME

(71) Applicant: KEM HONGKONG LIMITED, Tsimshatsui Kowloon (HK)

(72) Inventors: Ryuta Kuramochi, Kanagawa (JP); Eiji Kawamura, Kanagawa (JP)

(73) Assignee: KEM HONGKONG LIMITED, Tsimshatsui Kowloon (HK)

( * ) Notice: Subject to any disclaimer, the term of this patent is extended or adjusted under 35 U.S.C. 154(b) by 0 days.

(21) Appl. No.: 16/521,095

(22) Filed: Jul. 24, 2019

(65) Prior Publication Data

US 2020/0048948 A1 Feb. 13, 2020

(30) Foreign Application Priority Data

Aug. 7, 2018 (JP) ..... JP2018-148314
Apr. 26, 2019 (JP) ..... JP2019-086074

(51) Int. Cl.

| | |
|---|---|
| ***E05F 3/20*** | (2006.01) |
| ***E05F 3/14*** | (2006.01) |
| ***E05F 5/04*** | (2006.01) |
| ***A47K 13/12*** | (2006.01) |

(52) U.S. Cl.

CPC ..... *E05F 3/14* (2013.01); *A47K 13/12* (2013.01); *E05F 5/04* (2013.01); *E05F 2005/046* (2013.01)

(58) Field of Classification Search

CPC ..... E05D 11/06; E05D 11/08; E05D 11/082; E05D 11/084; E05D 11/10; E05D 11/105; E05D 11/1064; E05D 2011/1035; E05D 3/02; E05Y 2201/638; E05Y 2201/254; E05Y 2201/256; E05Y 2800/298; E05Y 2900/132; E05Y 2900/134; E05Y 2900/20; E05Y 2900/31; E05Y 2900/312; E05Y 2900/614; E05F 3/14; E05F 3/16; E05F 3/20; E05F 5/04; F16C 11/103; Y10T 16/5345; Y10T 16/54038; Y10T 16/54028; A47K 13/12; F05F 2005/046

See application file for complete search history.

(56) References Cited

U.S. PATENT DOCUMENTS 5,152,189 A * 10/1992 Miura ..... F16F 9/145 464/180
5,390,770 A * 2/1995 Miyahara ..... A47K 13/10 188/276
5,664,286 A * 9/1997 Sorimachi ..... A47K 13/12 16/54
5,697,122 A * 12/1997 Okabe ..... E05F 3/14 16/82

(Continued)

FOREIGN PATENT DOCUMENTS

DE 102015112160 A1 * 7/2016 ..... E05F 3/14
JP 10184741 A * 7/1998

(Continued)

*Primary Examiner* — Chuck Y Mah

(74) *Attorney, Agent, or Firm* — Notaro, Michalos & Zaccaria P.C.

(57) ABSTRACT

A fluid damper hinge using a fluid damper only and a damper hinge using the fluid damper in combination with a torsion damper, used especially in relation to an opening and closing element such as seat lid and seat for western-style toilet, wherein both have a simple structure, do not require time for assembly and can be manufactured at a low cost.

7 Claims, 35 Drawing Sheets

(56) References Cited

U.S. PATENT DOCUMENTS 5,720,370 A * 2/1998 Takahashi ..... F16F 9/145 188/306
5,768,718 A * 6/1998 Sorimachi ..... A47K 13/12 4/236
5,996,132 A * 12/1999 Sorimachi ..... A47K 13/12 4/236
6,000,069 A * 12/1999 Sorimachi ..... A47K 13/12 4/236
6,178,597 B1 * 1/2001 Suzuki ..... E05F 1/1223 16/303
6,213,881 B1 * 4/2001 Sasa ..... F16F 9/145 16/50
6,687,921 B1 * 2/2004 Li ..... A47K 13/12 188/307
6,840,355 B2 * 1/2005 Iwashita ..... A47K 13/10 188/290
7,111,712 B2 * 9/2006 Orita ..... F16F 9/145 188/290
8,516,657 B2 * 8/2013 Yoshida ..... E05F 3/20 16/50
9,115,519 B2 * 8/2015 Li ..... F16F 9/3214
9,255,621 B2 * 2/2016 Hu ..... F16F 9/369
9,492,041 B1 * 11/2016 Liang ..... F16F 9/44
2003/0234145 A1 * 12/2003 Iwashita ..... E05F 3/14 188/290
2005/0205370 A1 * 9/2005 Kanno ..... F16F 9/145 188/290
2009/0025181 A1 * 1/2009 Burger ..... E05F 3/14 16/286
2014/0190779 A1 * 7/2014 Horita ..... B62D 33/027 188/282.1
2019/0331190 A1 * 10/2019 Watanabe ..... F16J 15/16
2020/0096074 A1 * 3/2020 Orita ..... F16F 9/14

FOREIGN PATENT DOCUMENTS

JP 2009-297131 A 12/2009
JP 2011163472 A * 8/2011
JP 2017-133666 A 8/2017
JP 2017-198271 A 11/2017

* cited by examiner (a)

(b)

(c)

(d)

DAMPER HINGE AND WESTERN-STYLE TOILET USING THE SAME

FIELD OF THE INVENTION

The invention relates to a damper hinge suitable in use when an opening and closing body is opened and closed relative to an opened and closed body such as western-style toilet.

BACKGROUND ARTS

Conventionally, a damper hinge is used as a hinge used for opening and closing an opening and closing body such as seat lid and seat to an opened and closed body consisting of western-style toilet; with this hinge, an opening and closing torque can be controlled at the rear portion of the opened and closed body. Among these sorts of damper hinges, the one using a fluid damper as is disclosed in JP Laid-Open Patent Application 2004-122286, the one using torsion spring as is disclosed in JP Laid-Open Patent Application 2015-002950, and the one in which a fluid damper and a torsion spring are combined as is disclosed in JP Laid-Open Patent Application 2009-297131 are known.

SUMMARY OF THE INVENTION

However, the damper hinge using a fluid damper as is disclosed in JP Laid-Open Patent Application 1-133666 has a complex structure, so the one with a simpler structure and less expensive manufacturing costs is required. Still further, the damper hinge using torsion spring as is disclosed in JP Laid-Open Patent Application 20152 can solely urge an opening and closing body in an opening direction, but in the opened state of the opening and closing body, the opening and closing body very often tends to rise up due to oscillations or shaking. Still further, the one disclosed in JP Laid-Open Patent Application 20093 has a problem in that it has a complex structure and it takes time since it requires a jig in assembly, and so on. Still further, a seat has a different weight and rotation torque from seat lid, so that a damper hinge compatible both with seat lid and seat is required.

Therefore, based on the above, a first object of the invention is to provide a damper hinge especially for seat lid which has a simple structure, requires no time in assembly and can be manufactured at a low cost.

A second object of the invention is to provide a damper hinge with which an opening and closing body can be opened and closed to avoid the opening and closing body from rising up or from freely falling in its fully opening state.

To achieve the above-mentioned object, a damper hinge according to the first aspect of the present invention is a damper hinge using a fluid damper mechanism for openably and closably attaching an opening and closing body to an opened and closed body, characterized in that the fluid damper mechanism comprises a cylinder case open at one end to be attached to the opened and closed body; a plurality of locking ridges provided in an axial direction on an inner circumferential wall of a fluid housing chamber provided on the cylinder case; a valve piece engaged with each locking ridge and having a U-shaped cross section; a cap attached to the fluid housing chamber of the cylinder case; and a rotation shaft attached to the opening and closing body, wherein the rotation shaft passes through the cap in a water-tight state and encapsulating a plurality of blade portions provided to protrude on its one end portion side, wherein the damper hinge is structured, such that fluid passages are formed between each valve piece and said locking ridge, between the arc-shaped groove provided on the lateral wall of the cylinder case and the blade portions and between a medium diameter shaft portion, wherein the blade portion protrudes on it and the locking ridge, during a rotation of the rotation shaft.

In this case, a damper hinge according to the second aspect of the present invention is characterized in that for inserting a valve piece into a locking ridge to engage with the latter on its lateral end portion side, an insertion regulating piece portion is provided on the valve piece for regulating its insertion direction.

Still further, a damper hinge according to the third aspect of the present invention is a damper hinge using a fluid damper mechanism and a torsion damper mechanism for openably and closably attaching an opening and closing body to an opened and closed body, characterized in that the fluid damper mechanism comprises a cylinder case open at one end to be attached to the opened and closed body, a fluid housing chamber and a torsion housing chamber being provided across a partition wall; a plurality of locking ridges provided in an axial direction on an inner circumferential wall of said fluid housing chamber provided on the cylinder case; a valve piece engaged with each engaging ridge and having a U-shaped cross section; a cap attached to an open end side of the cylinder case; and a rotation shaft attached to the opening and closing body, wherein the rotation shaft passes through the cap in a water-tight state and a plurality of blade portions are provided to protrude on its one end portion side f, wherein the fluid damper mechanism is structured, such that fluid passages is formed between each valve piece and the locking ridge-shaped groove provided on the lateral wall of the cylinder case and the blade portions and between a medium diameter shaft portion, wherein the blade portion protrudes on it and the locking ridge, during a rotation of the rotation shaft, and wherein the torsion damper mechanism comprises a link shaft rotatably provided in the torsion housing chamber, passing through the partition wall and engaging with the rotation shaft in an axial direction in the fluid housing chamber, a cap attached to an opening end of a damper housing chamber to pivotally supporting one end portion of the link shaft; and a torsion spring wound around the link shaft between the link shaft and the cylinder case.

In this case, a damper hinge according to the fourth aspect of the present invention is characterized in that for inserting the valve piece according to the third aspect of the invention into the locking ridge to engage with the latter on its lateral end portion side, an insertion regulating piece portion being provided on said valve piece for regulating its insertion direction.

Additionally, a damper hinge according to the fifth aspect of the present invention is characterized in that for connecting a rotation shaft and a link shaft via said partition wall, a torsion damper mechanism is first assembled, and then the rotation shaft is inserted into an inlet portion of the fluid housing chamber, and then the link shaft is engaged and thereafter the rotation shaft is rotated to insert the blade portions into the fluid housing chamber, in order to set an initial torque to the link shaft.

Additionally, a damper hinge according to the sixth aspect of the present invention is characterized in that for connecting a rotation shaft coaxially with a link shaft, a deformed insertion portion is provided on a link shaft side, and a deformed receiving hole portion is provided on a rotation shaft side.

Still further, a damper hinge according to the seventh aspect of the present invention is characterized in that for coaxially coupling a rotation shaft and a link shaft via a partition wall, one of the rotation shaft and the link shaft is borne and axially coupled to a bearing hole provided on the partition wall.

A damper hinge according to the eighth aspect of the present invention is characterized in that arc-shaped grooves are provided between a surface portion of a valve member and blade portions provided on a rotation shaft.

A damper hinge according to the ninth aspect of the present invention is characterized in that arc-shaped grooves are provided between each valve piece portion of a valve member and locking ridges provided on a rotation shaft.

Still further, the invention according to the tenth aspect of the present invention is a western-style toilet using the damper hinge according to the first to tenth aspect of the present invention.

Since the present invention is constructed as in the foregoing, we can provide according to the first aspect of the invention an inexpensive damper hinge which has a smaller number of parts and a simpler structure, and can absorb an impact in closing an opening and closing body relative to an opened and closed body.

According to the second aspect of the invention, when a valve member is inserted into locking ridges to engage with them, its insertion regulating piece portion prevents an error in insertion directions, so that it can prevent an assembly error as well as a cost increase due to reassembly resulting from assembly error.

According to the third aspect of the invention, a shock when an opening and closing body is closed relative to an opened and closed body can be absorbed, and when the opening and closing body is opened relative to the opened and closed body, it can be opened without making feel the own weight of the opening and closing body; still further, the invention can prevent the opening and closing body from rising up when the opening and closing body is closed.

According to the fourth aspect of the invention, when a valve member is inserted into locking ridges to engage with them, its insertion regulating piece portion prevents an error in insertion directions, so that it can prevent an assembly error as well as a cost increase due to reassembly resulting from assembly error.

According to the fifth aspect of the invention, the fluid can circulate not only via a first fluid passage but also via a second fluid passage, so that it is possible to provide a damper hinge with an improved operability.

According to the sixth aspect of the invention, it is possible to provide a damper hinge, wherein a coupling and engagement between a link shaft and a rotation shaft are reliable.

According to the seventh aspect of the invention, it is possible to coaxially couple across a partition wall a rotation shaft and a link shaft which have different functions from each other.

According to the eighth aspect of the invention, an arc-shaped groove is provided between a surface portion of a valve member and blade portions of a rotation shaft, it is possible to optionally fix an angle range within which a fluid damper mechanism operates.

According to the ninth aspect of the invention, the fluid can circulate not only via an arc-shaped groove but also via an arc-shaped groove, so that it is possible to provide a damper hinge with an improved operability.

According to the tenth aspect of the invention, it is possible to provide a western-style toilet using a damper hinge with above-mentioned characteristics.

DETAILED DESCRIPTION OF THE INVENTION

In the following, embodiments of the invention are explained in detail, based on drawings. In the following, a damper hinge is described as a hinge used for opening and closing an opening and closing body such as seat lid and seat to an opened and closed body consisting of western-style toilet, however, the damper hinge according to the invention is not limited to such, but can be used for opening and closing an opening and closing body such as lid relative to an opened and closed body of a cabinet. Therefore, for this reason, hereinafter an opening and closing body is referred to as seat lid of a western-style toilet in Embodiment 1, and next, as seat of in Embodiment 2, and as opening and closing body in claims.

Figure 1A:
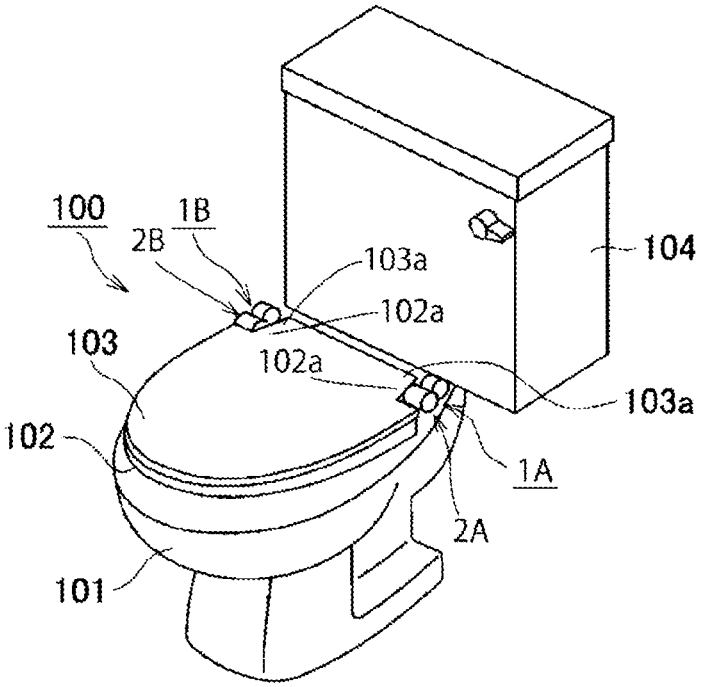
FIGS. 1A and 1B show a western-style toilet using a damper hinge according to the invention, FIG. 1A being its perspective view, and FIG. 1B—its perspective view with a seat lid being opened.
Figure 1B:
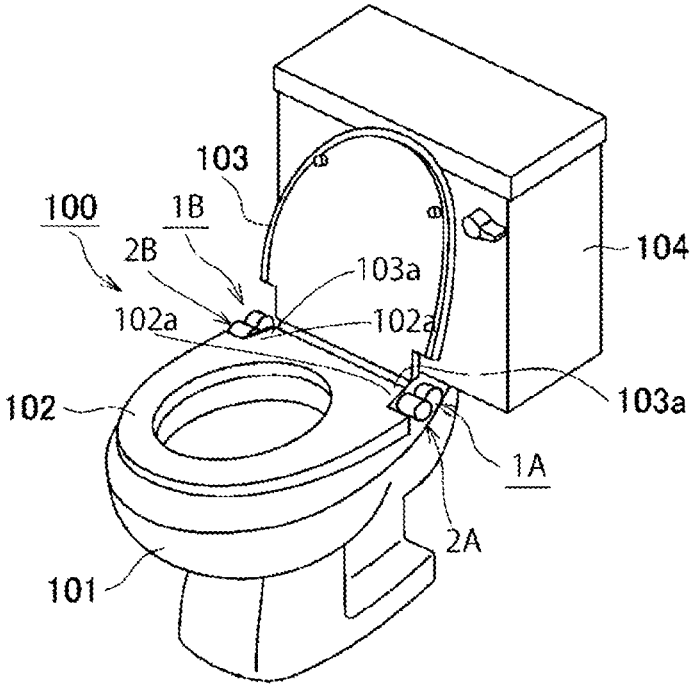

FIGS. 1A and 1B show a western-style toilet 100 using a damper hinge according to the invention. As shown in the drawings, the western-style toilet 100 comprises a toilet main body 101, a seat 102, a seat lid 103, a pair of damper hinges 1A, 1B for the seat lid 103, a pair of damper hinges 2A, 2B for the seat 102 and a tank 104. The damper hinges 1A, 1B and the damper hinges 2A, 2B may be both used as hinges of identical structure on the right and left, but it is also possible that respectively one damper hinge 1A and one damper hinge 2A are only the ones according to the invention, and other damper hinge 1B and the damper hinge 2B are the ones of different structure.

Embodiment 1

First, reference is made to damper hinges 1A, 1B for a seat lid 103. These damper hinges 1A, 1B assume that both of them on the right and left have an identical structure, as described above, and in the following, reference is made to the damper hinge 1A on the right as viewed from the front of a toilet main body 101. Needless to say, the damper hinge 1B on the left may have a structure different from the damper hinge 1A on the right.

As shown in FIGS. 1 to 7, the damper hinge 1A according to the invention comprises a cylinder case 2 having a lateral wall 2*a* on its one lateral end portion and with a cap 3 being attached to the other end portion in water-tight state, a fluid housing chamber 4 surrounded by the lateral wall 2*a*, an inner circumferential wall 2*b* and the cap 3 and formed in this manner, a rotation shaft 5 provided in water-tight state wherein the cap 3 rotatably passing through an axial central portion in an axial direction within the fluid housing chamber 4, and a fluid damper mechanism R1 provided in the fluid housing chamber 4.

The cylinder case 2 is made of synthetic resin, and in particular as shown in FIGS. 2 to 5, a pair of attaching portions 2*c*, 2*d* used to attach to a western-style toilet 100 are spaced apart to face each other and to protrude, and an attaching portion 2*e* having an attaching portion 2*e*' protrudes from one lateral portion. A cap attaching hole portion 2*f* slightly larger in diameter than an inner diameter in its inside is provided on an inlet side of the fluid housing chamber 4, and a pair of locking ridges 2 *g*, 2 *g* are provided inside an inner circumferential wall 2*b* at an interval of 180 degrees in an axial direction from a lateral wall 2*a* side. Arc-shaped grooves 2*h*, 2*h* are provided to guide a fluid in a circumferential direction from a base portion area of each locking ridge 2*g*, 2*g*, and a pivotally supporting circumferential groove 5*g* is also provided on an axial center in an axial direction on the side with blade portions 5*f*, 5*f* and pivotally attached to a pivotally supporting cylindrical portion 2*j* of the cylindrical case 2 in a rotatable manner. Furthermore, two fixing holes 2*i*, 2*i* in the embodiment are provided at an interval of 180 degrees from an outer circumference to an inner circumference of a cap attaching hole portion 2*f* of the cylindrical case 2. In the meantime, a number of these fixing holes is not limited to what is described in this embodiment.

A cap 3 is fitted into a cap attaching hole portion 2*f*, and made of synthetic resin as well; a shaft insertion hole 3*a* is provided on an axial center in an axial direction, and attaching holes 3*b*, 3*b* are provided toward a radial direction in alignment with positions of the fixing holes 2*i*, 2*i*. Still further, the cap 3 is structured to be fixedly attached to the cap attaching hole portion 2*f* with springs 3*c*, 3*c* pressed into attaching holes 3*b*, 3*b* via fixing holes 2*i*, 2*i*. Simple pins or attaching screws can be used instead of the spring pins 3*c*, 3*c*.

The fluid housing chamber 4 is a spatial area surrounded by the lateral wall 2*a*, an inner circumferential wall 2*b* and the cap 3, houses a rotation shaft 5 together with blade portions 5*f*, 5*f* and is filled with damper oil 7 in its inside.

Figure 2:
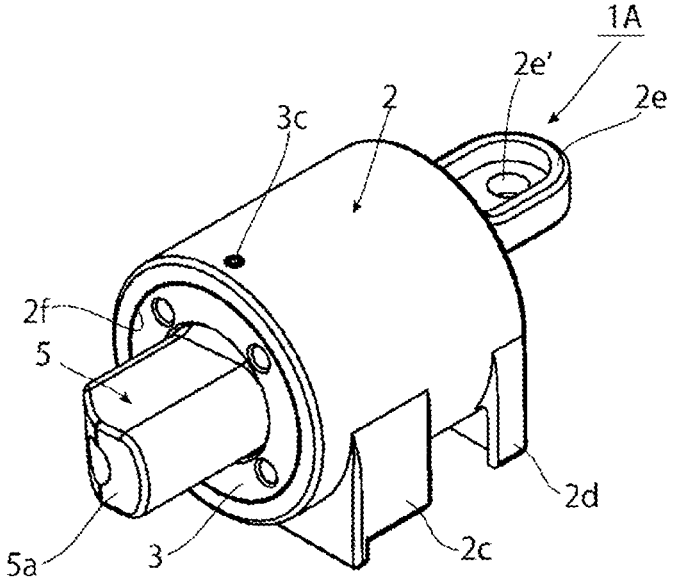
FIG. 2 shows a perspective view of a damper hinge for a seat lid according to the invention.
Figure 3:
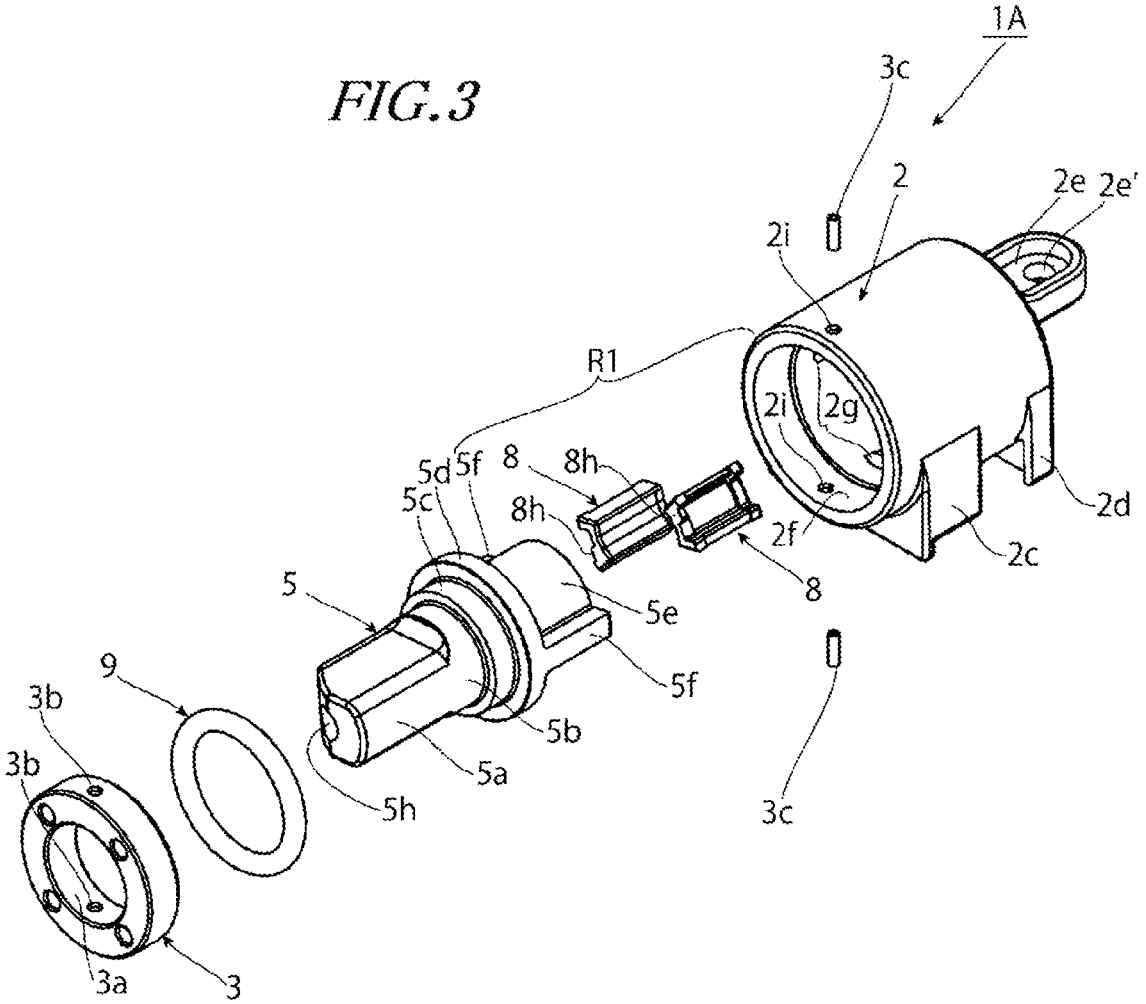
FIG. 3 shows an exploded perspective view of a damper hinge shown in FIG. 2.
Figure 4:
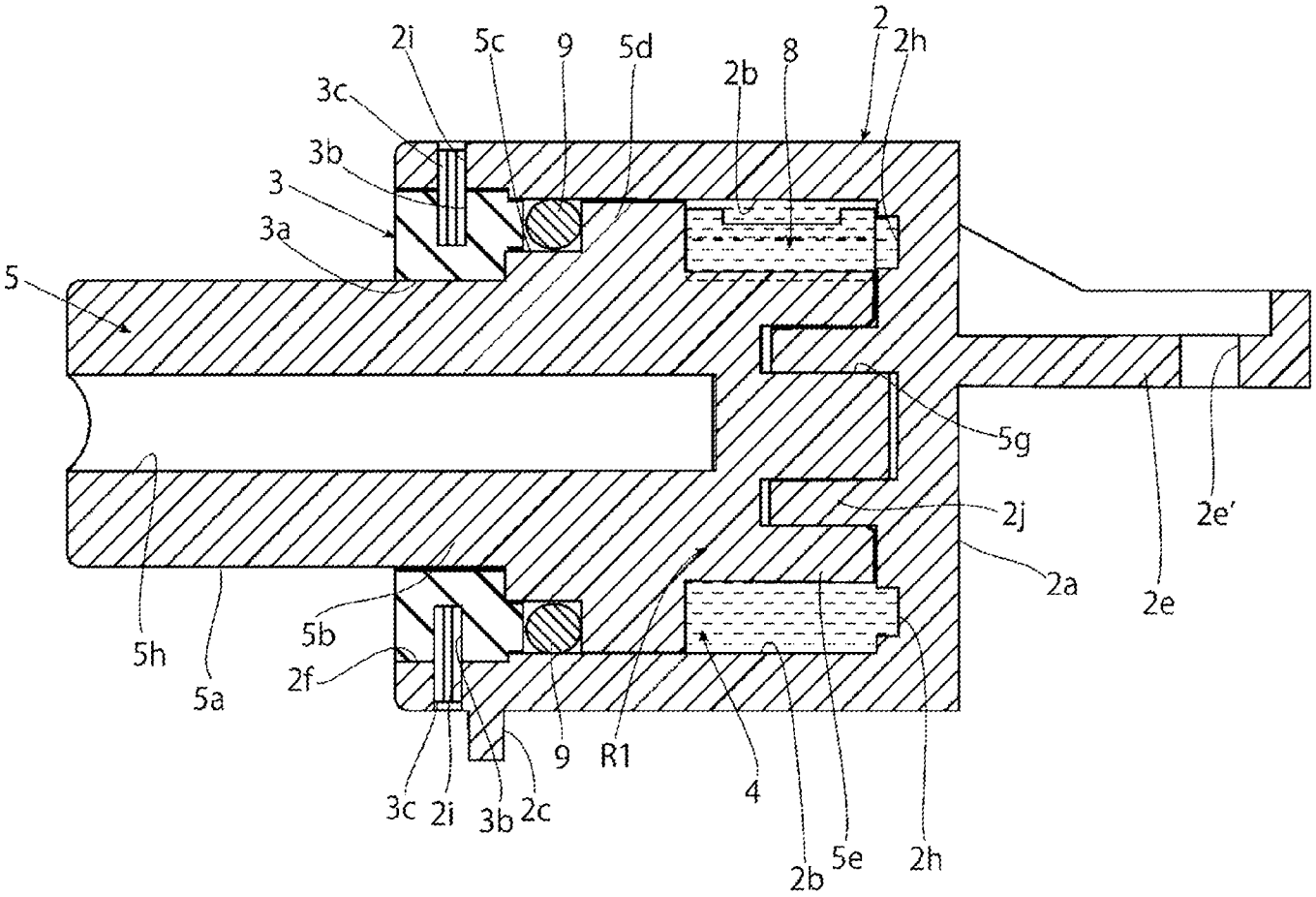
FIG. 4 shows a longitudinal cross section view illustrating an inner structure of a damper hinge shown in FIG. 2.
Figure 5A:
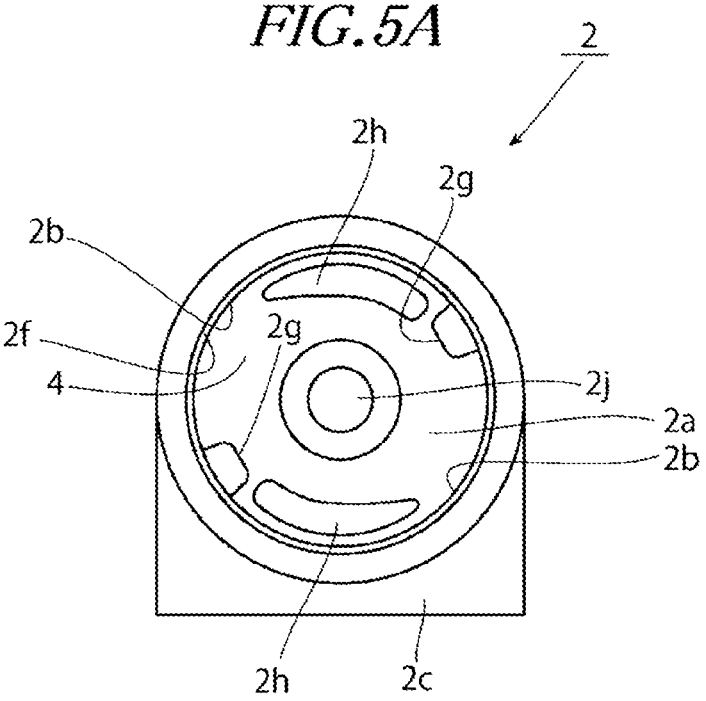
FIGS. 5A and 5B show a cylinder case of a damper hinge as shown in FIG. 2, FIG. 5A being its left lateral view, and FIG. 5B—its longitudinal cross section view.
Figure 5B:
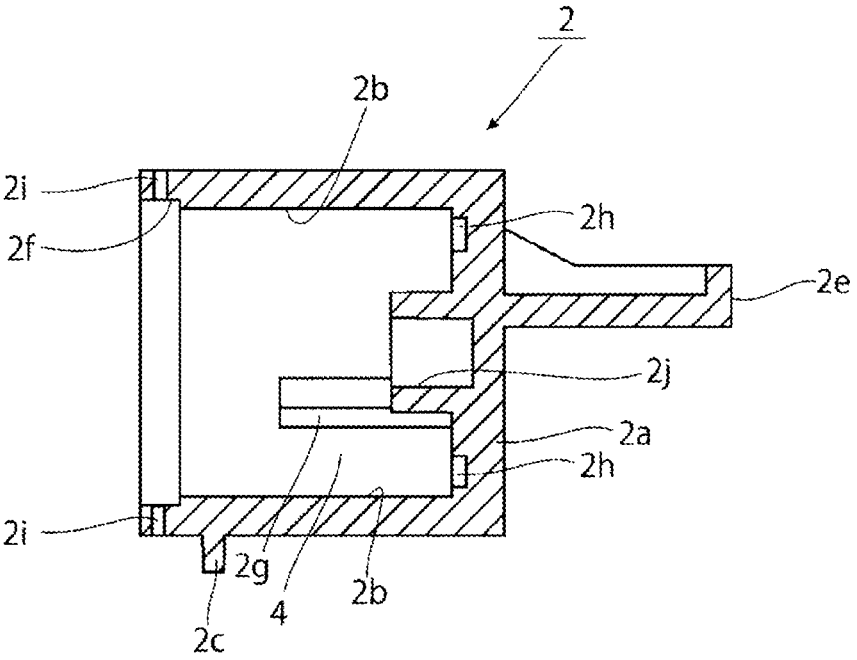
Figure 6A:
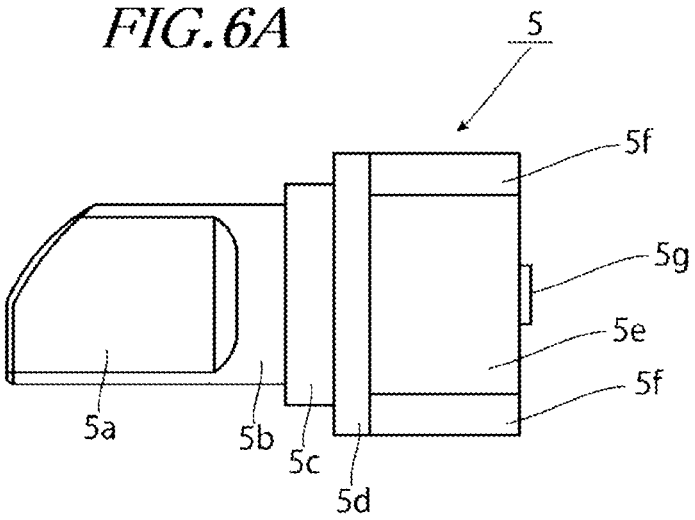
FIGS. 6A to 6C show a rotation shaft of a damper hinge as shown in FIG. 2, FIG. 6A being an elevation view, FIG. 6B—a right lateral view, and FIG. 6C—its longitudinal cross section view.
Figure 6B:
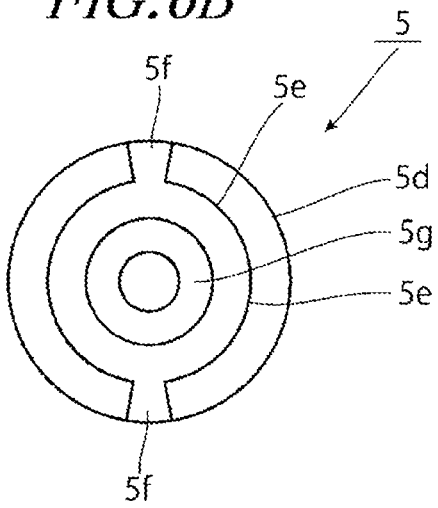
Figure 6C:
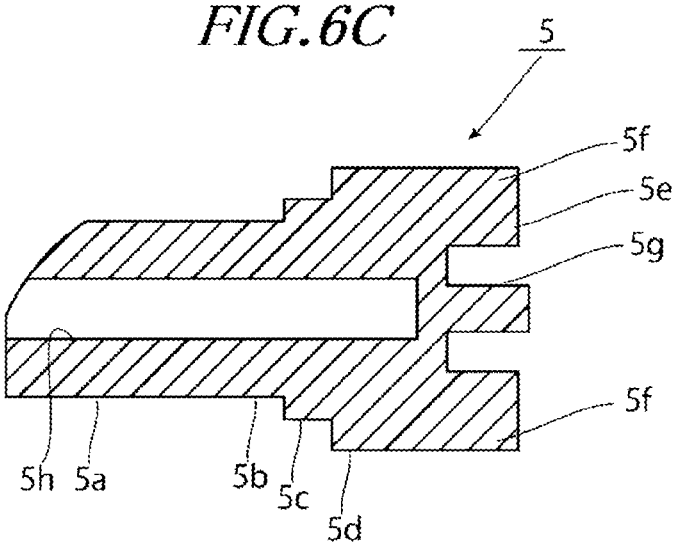

The rotation shaft 5 is made of synthetic resin as well, and as shown in FIGS. 3, 4 and 6, and comprises, as seen from one end portion, an attaching deformed shaft portion 5*a*, a shaft supporting portion 5*b* provided next to the attaching deformed shaft portion 5*a*, a large diameter portion 5*c* provided next to the shaft supporting portion 5*b*, a flange portion 5*d* provided next to the large diameter portion 5*c*, and a pair of blade portions 5*f*, 5*f* provided to protrude at an interval of 180 degrees in a radial direction of a medium diameter portion 5*e* having a smaller diameter than the flange portion 5*d*. The rotation shaft 5, except an area of the attaching deformed shaft portion 5*a*, is rotatably housed in a fluid housing chamber 4 in a water-tight state as shown in FIGS. 2, 4, as described below, wherein the blade portions 5*f*, 5*f* are inserted between respective valve pieces 8, 8 to be described below and a circumferential surface of the medium diameter portion 5*e* abuts against bottom surfaces of respective valve pieces 8, 8.

Still further, a fluid damper mechanism R1 comprises a first fluid housing chamber 4*a* and a second fluid housing chamber 4*b* provided in the fluid housing chamber 4, a pair of blade portions 5*f*, 5*f* provided on a rotation shaft 5 and respectively placed in the first fluid housing chamber 4*a* and the second fluid housing chamber 4*b*, a pair of locking ridges 2*g*, 2*g* provided to protrude in an axial direction from an inner circumferential wall 2*b* of the fluid housing chamber 4, a pair of valve pieces 8, 8 having a U-shaped cross section and locked to the pair of locking ridges 2*g*, 2*g* so as to be movable by a narrow width in a circumferential direction, arc-shaped grooves 2*h*, 2*h* provided for guiding a fluid in a circumferential direction from a base portion of each locking ridge 2*g*, 2*g*, and a damper oil 7 filled into the fluid housing chamber 4.

Figure 7A:
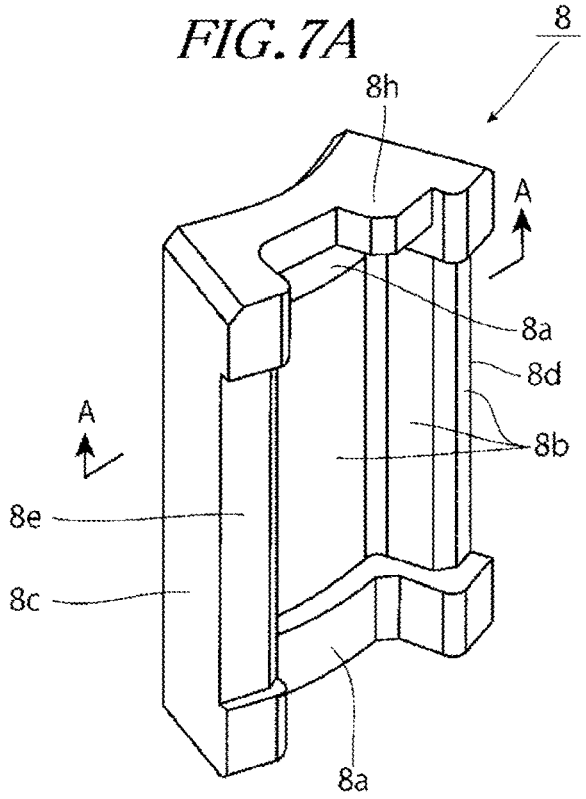
FIGS. 7A to 7C show a valve piece of a damper hinge as shown in FIG. 2, FIG. 7A being its perspective view, and FIG. 7B—its longitudinal cross section in line A-A, and FIG. 7C—its cross section showing an engaging state of locking ridges and the valve piece.
Figure 7B:
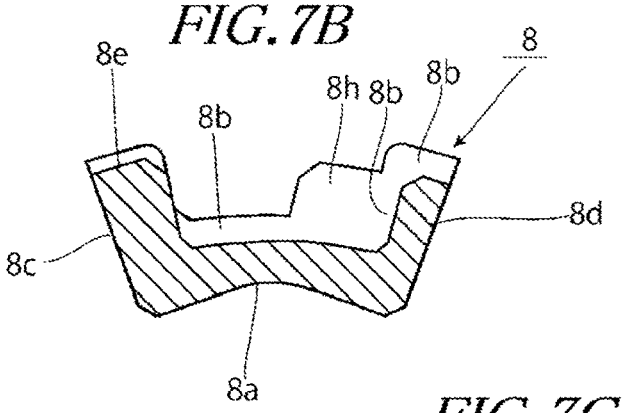
Figure 7C:
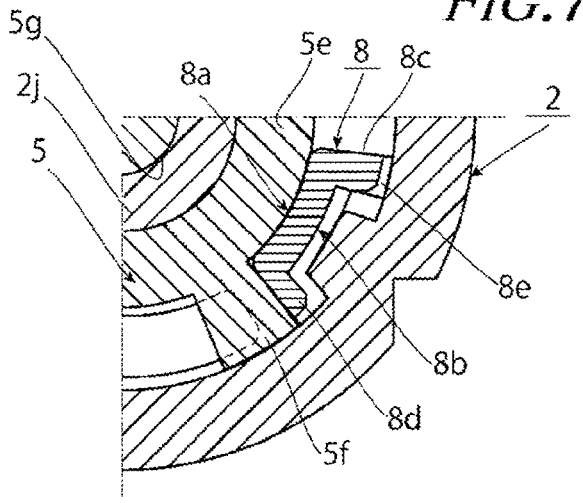

Since each valve piece 8, 8 has an identical structure, reference is made hereinafter to only one of these. Especially as shown in FIG. 7, a valve piece 8 comprises lateral walls 8*c*, 8*d* erected from a base portion 8*a* and has a substantially U-shaped cross section in a direction perpendicular to its extending direction; it is formed to be thinner from a top portion to an inner lateral portion and further to an inner part of a bottom portion 8*a*, so that a groove portion 8*b* is provided and a groove portion 8*e* is provided on a top portion of the other lateral portion. When the valve piece 8 is inserted into the locking ridge 2*g* to engage with it, a gap is generated between both sides of the locking ridge 2*g* and inner parts of the lateral walls 8*c*, 8*d*, the valve piece 8 can rotate by the gap in a circumferential direction relative to the locking ridge 2*g*. In this case, when the lateral wall 8*c* is in contact with a lateral portion of the locking ridge 2*g*, no gap is generated with the lateral wall 8*c*, so that a first fluid passage 10*a* to be described below is not formed, however, when the lateral wall 8*c* is away from the lateral portion of the locking ridge 2*g*, the groove portion 8*b* is connected with the groove portion 8*e* provided on the top portion of the lateral wall 8*c*. A further fluid passage is also formed by arc-shaped grooves 2*h*, 2*h* and blade portions 5*f*, 5*f*, and referred to as second fluid passage 10*b*. A further fluid passage is also formed by outer lateral surface of a bottom portion 8*a* of the valve piece 8 and a medium diameter portion 5*e* of a rotation shaft 5. This is referred to as third fluid passage 11*a* in the present description.

Next, reference is made to an example of assembly procedure of the damper hinge 1A according to the invention. First, each valve piece 8, 8 is fitted onto a locking ridge 2*g*, 2*g* and thus mounted to it. Here, an insertion regulating piece portion 8*h*, 8*h* is provided on one side edge portion of each valve piece 8, 8, in order to prevent a mistake in insertion direction. Next, after a required amount of damper oil 7 is injected into a fluid housing chamber 4, with a sealing member 9 such as O-ring being attached to an outer circumference of a large diameter portion 5*c* of a rotation shaft 5, a blade portion 5*f*, 5*f* is first inserted into a space between locking ridge 2*g*, 2*g* in the fluid housing chamber 4. Then, as the blade portion 5*f*, 5*f* has an outer diameter of the same size as an inner diameter of a cylinder case 2, the blade portion 5*f*, 5*f* is inserted into the cylinder case 2. Next, a cap 3 is fitted into a cap attaching hole portion 2*f* of the cylinder case 2, with an axial supporting portion 5*b* of the rotation shaft 5 being inserted into its shaft insertion hole 3*a*; then, since the cap attaching hole portion 2*f* is a stepped hole of a diameter larger than an inner diameter of a fluid housing chamber 4 as shown in FIGS. 3, 4, the cap 3 is mounted into the cap attaching hole portion 2*f* on an open end side of the cylinder case 2, without entering too much into the fluid housing chamber 4. At the same time, a flange portion 5*d* of the rotation shaft 5 is pressed by the cap 3, so that the outside of a blade portion 5*f*, 5*f* of the rotation shaft 5 abuts against an inner circumferential wall of the fluid housing chamber 4, and an outer circumference of a medium diameter portion 5*e* of the rotation shaft 5 abuts against the outer lateral surface of a bottom portion 8*a* of a valve piece 8, 8.

Here, a sealing member 9 is deformed to assist a press contact state of a large diameter portion 5*c* of the rotation shaft 5 and an inner circumferential wall 2*b* of the fluid housing chamber 4. Next, a cap 3 is fixed to a cylinder case 2 using spring pins 3*c*, 3*c*. If it is fixed in this manner, the cylinder case 2 and a rotation shaft 5 are sealed in water-tight state by a sealing member 9, with an attaching deformed shaft portion 5*a* protruding outside from the cylinder case 2, especially as shown in FIG. 2. Then, especially as shown in FIGS. 8A to 8D, a first fluid chamber 4*a* and a second fluid chamber 4*b* partitioned by a medium diameter portion 5*e* of the rotation shaft 5, a lateral wall 2*a*, valve pieces 8, 8 and a flange portion 5*d* is formed in the fluid housing chamber 4 of the cylinder case 2, wherein damper oil 7 is filled in their inside. In this manner, an assembly is completed, and a fluid damper mechanism R1 is formed.

Next, reference is made to an operation of the damper hinge 1A. Especially as shown in FIGS. 1, 2, the damper hinge 1A enables the seat lid 103 to be openably and closably attached to the toilet main body 101, by inserting and fixing the attaching deformed shaft portion 5*a* of the rotation shaft 5 to the deformed attaching hole (not shown) provided on the attaching portion 103*a* of the seat lid 103, then by inserting the attaching portion 2*c*, 2*d* provided on its cylinder case 2 into the attaching hole (not shown) provided on the toilet main body 101. Though in this embodiment the pair of damper hinges 1A, 1B are used, reference is made in the following to the operation of the only one damper hinge 1A. The damper hinge 1A performs the closing operation for closing the seat lid 103 from the opened position shown in FIG. 8A to the closed position shown in FIG. 8D, and inversely, the opening operation for opening the seat lid 103 from the closed position shown in FIG. 8D to the opened position shown in FIG. 8A.

Figure 8A:
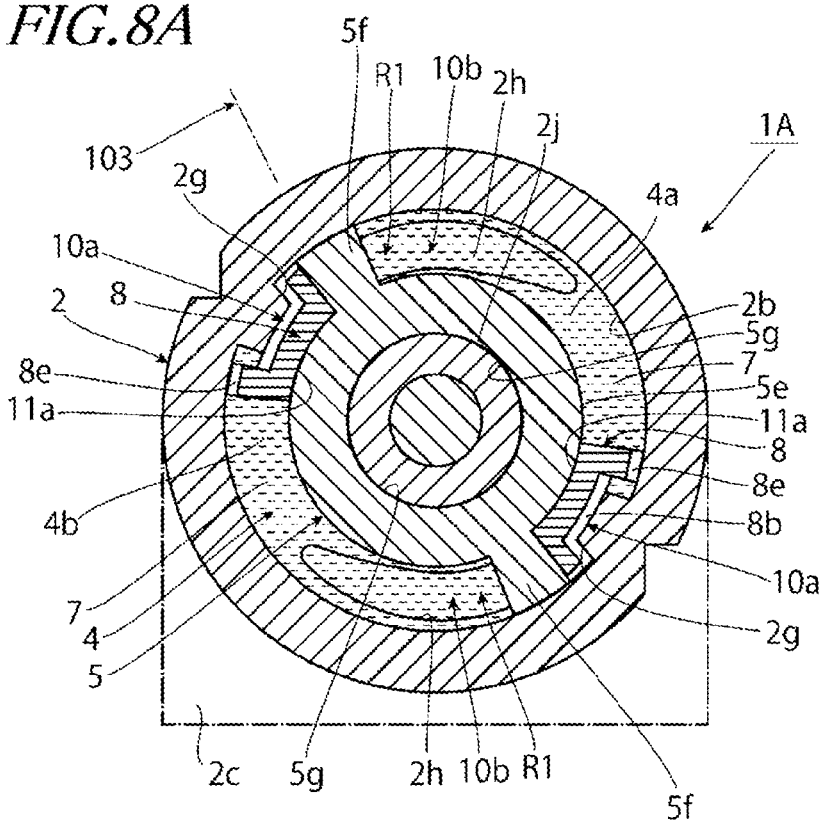
FIGS. 8A and 8B are illustrative views of a damper hinge, FIG. 8A being a fully opened state of a seat lid, and FIG. 8B—a state at the start of its closing.
Figure 8B:
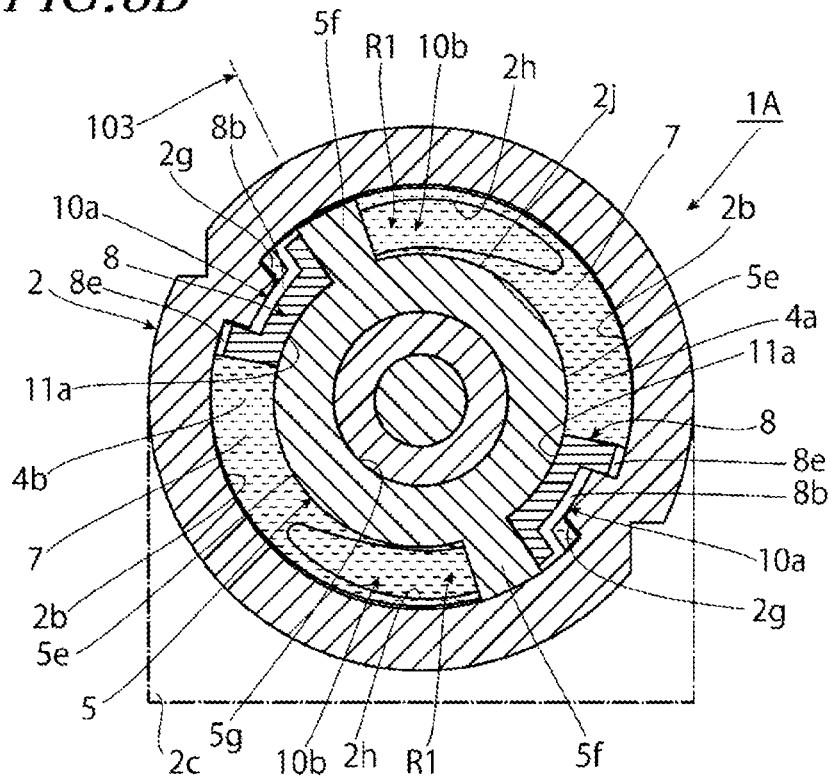

For closing the seat lid 103 from the fully opened position, since the fluid 7, 7 circulates at the beginning via the second fluid passage 10*b*, 10*b* formed by the arc-shaped grooves 2*h*, 2*h* in the first fluid housing chamber 4*a* and the second fluid housing chamber 4*b*, as shown in FIG. 8B, the closing operation takes place with a small force. For further closing the seat lid, the second fluid passage 10*b*, 10*b* is closed, so the fluid resistance is greater, but the fluid 7, 7 here circulates via the third fluid passage 11*a*, 11*a* to assure a slow closing action of the seat lid 103.

Namely, in order to describe in more detail the closing action of the seat lid 103 from its fully opened position, in the fully opened position of the seat lid 103, the valve 8, 8 is located at the position at which it has rotated anticlockwise, and the first fluid passage 10*a*, 10*a* is opened. When the user closes the seat lid 103 using his/her own hands from the fully opened position, the rotation shaft 5 rotates clockwise in the drawings. First, the first fluid passage 10*a*, 10*a* is closed as is pressed by the damper oil 7, 7, but the second fluid passage 10*b*, 10*b* from the arc-shaped grooves 2*h*, 2*h* then allows the damper oil 7, 7 to move from one of the first fluid housing chamber 4*a* and the second fluid housing chamber 4*b* to the other, so that the seat lid 103 is smoothly closed.

Figure 8C:
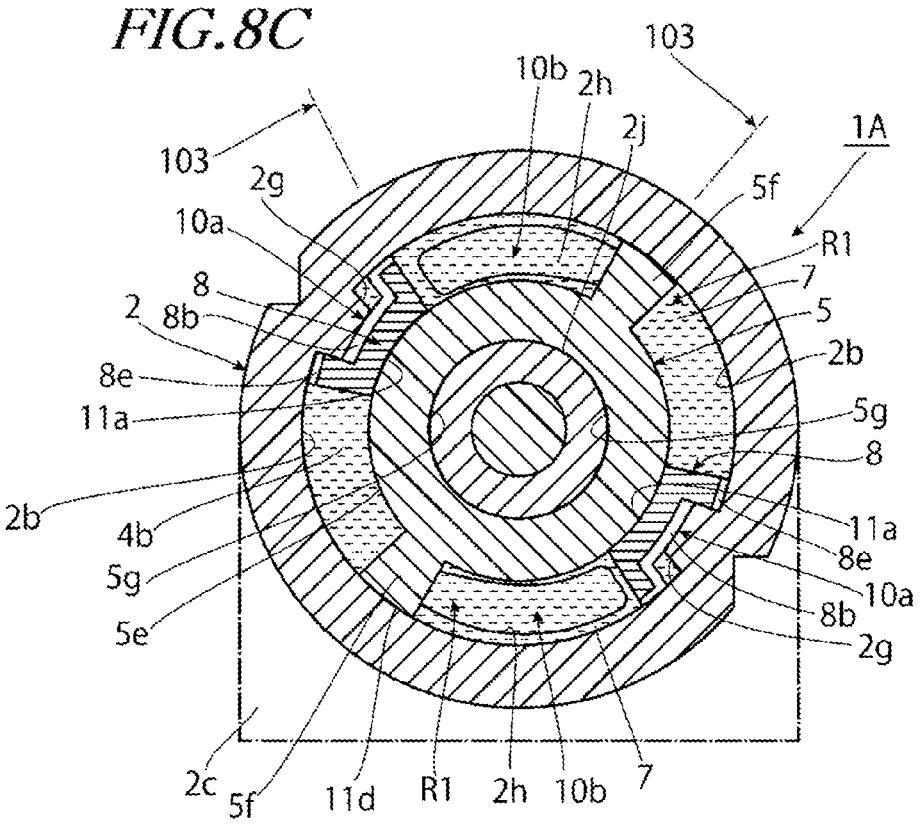
FIGS. 8C and 8D are illustrative shows views showing a damper hinge, FIG. 8C being an intermediate closed state of a seat lid, and FIG. 8D—a fully closed state of a seat lid.
Figure 8D:
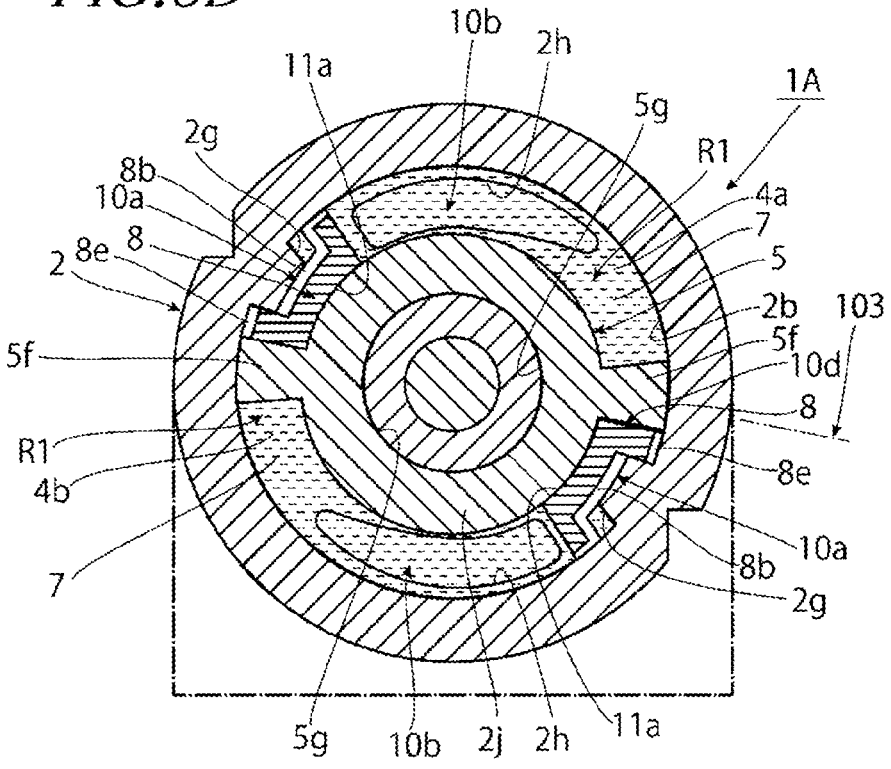
Figure 9A:
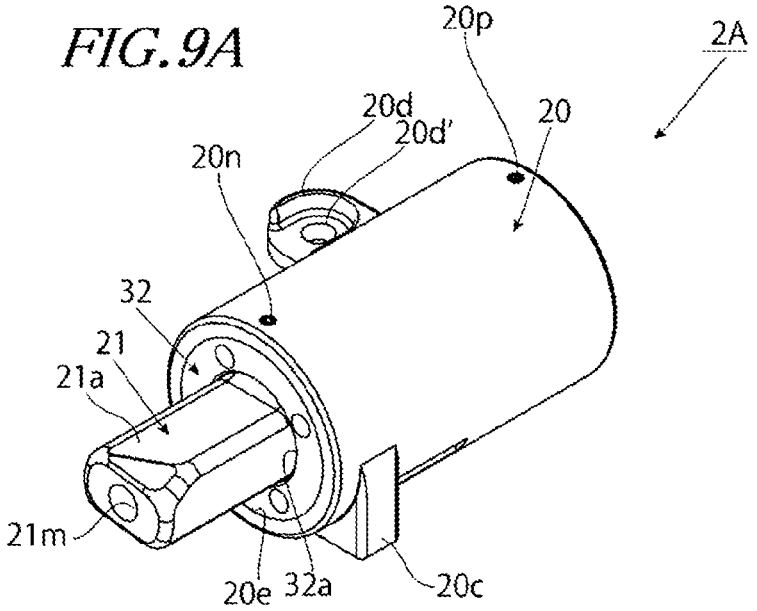
FIGS. 9A to 9C show a rotation shaft of a damper hinge according to Embodiment 2, FIG. 9A being a perspective view, FIG. 9B—a plan view, and FIG. 9C—a left lateral view.
Figure 9B:
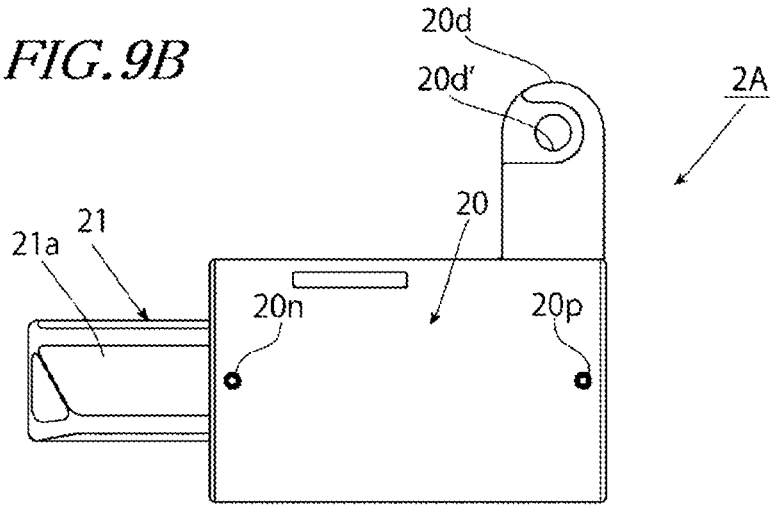
Figure 9C:
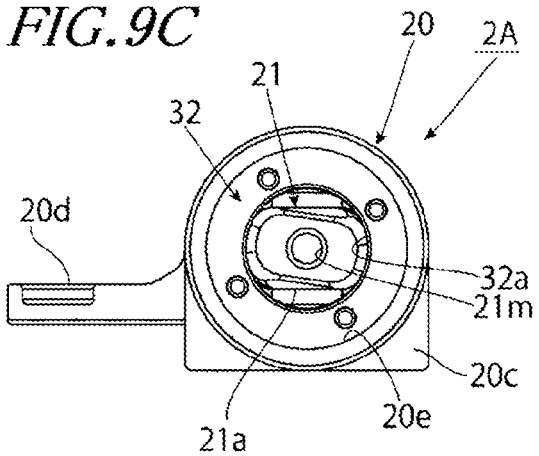

Next, when the seat lid 103 is further closed, the second fluid housing chamber 4*b* only is closed as shown in FIG. 8C, and the damper oil 7, 7 starts to move only via the third fluid passage 11*a*, 11*a*, so that the seat lid 103 is slowly closed to reach the fully closed state as shown in FIG. 8D.

Next, reference is made to the opening of the seat lid 103 from the fully closed state shown in FIG. 8D. When the seat lid 103 is fully closed, as shown in FIG. 8D, each blade portion 5*f*, 5*f* is located on the lateral portion of each locking ridge 2*g*, 2*g* opposed to the one shown in FIG. 8A; however, when the user holds and lifts the front side of the seat lid 103, the rotation shaft 5 starts to rotate anticlockwise to allow the opening operation of the seat lid 103. Here, the valve piece 8, 8 is rotated anticlockwise by the damper oil 7, 7 in the first fluid housing chamber 4*a* and the second fluid housing chamber 4*b*, which is pressed by the blade portion 5*f*, 5*f*, and the damper oil 7, 7 is made to circulate from the first fluid housing chamber 4*a* to the second fluid housing chamber 4*b*, so that the seat lid 103 is smoothly opened.

When the seat lid 103 is opened to the intermediate opening angle (60 degrees according to the embodiment), the second fluid passage 10*b*, 10*b* is opened by the further opening operation of the seat lid 103, so that the seat lid 103 can be more smoothly opened to reach the fully opened state as shown in FIG. 8A.

In the meantime, the fully opened angle for the seat lid 103 is 120 degrees, but the invention is not limited hereto. The fully opened angle can be fittingly set. For example, for urination, the seat 102 and the seat lid 103 need not be opened to the fully opened position, i.e. an angle greater than 90 degrees, but can be stopped and held at 60 or 70 degrees.

Furthermore, the damper hinge as described above is used as a hinge for opening and closing the seat lid for the western-style toilet, but the invention is not limited hereto. As mentioned above, it is widely applied, not only for a toilet seat, but also when it is necessary to buffer an opening and closing body in its opening and closing, as well as when it is necessary to hold the opening and closing body in its self-standing state. For example, various opening and closing bodies for electric appliances, a cabinet, an opening and closing display body for OA equipment, etc. can be listed.

Embodiment 2

In the following, another embodiment according to the invention is explained based on drawings. In the following, damper hinges 2A, 2B are described as a hinge used for opening and closing a seat 102 of western-style toilet, however, the damper hinges 2A, 2B according to the invention are not limited hereto, but can be used for opening and closing an opening and closing body such as seat lid, or a lid body for various electric appliances or a cabinet, etc., as in Embodiment 1. Therefore, for this reason, hereinafter an opening and closing body is referred to as seat, but as opening and closing body in claims.

These damper hinges 2A, 2B assume that both of them on the right and left have an identical structure, and in the following, reference is made to the damper hinge 2A on the right as viewed from the front of a toilet main body 101. Needless to say, the damper hinge 2B on the left may have a structure different from the damper hinge 2A on the right.

As shown in FIG. 9 to 16, the damper hinge 2A according to Embodiment 2 comprises a cylinder case 20 having a partition wall 20*a* provided with a bearing hole 20*b* passing through an axial center in an axial direction substantially on a central portion in its inside, a rotation shaft 21 rotatably attached in water-tight state in a fluid housing chamber 22 provided on one side across the partition wall 20*a*, a link shaft 24 in a torsion housing chamber 23 provided on the other side across the partition wall 20*a*, coupled to the rotation shaft 21 in the fluid housing chamber 22 and provided to be rotatable together with the rotation shaft, a fluid damper mechanism R2 provided on the rotation shaft 21 side, and a torsion damper mechanism T using a torsion spring 28 provided on the link shaft 24 side. The fluid damper mechanism R2 differs from a fluid damper mechanism R1 according to Embodiment 1 only in that the partition wall 20*a* is used instead of a lateral wall 2*a*, and otherwise it has identical components.

Figure 11:
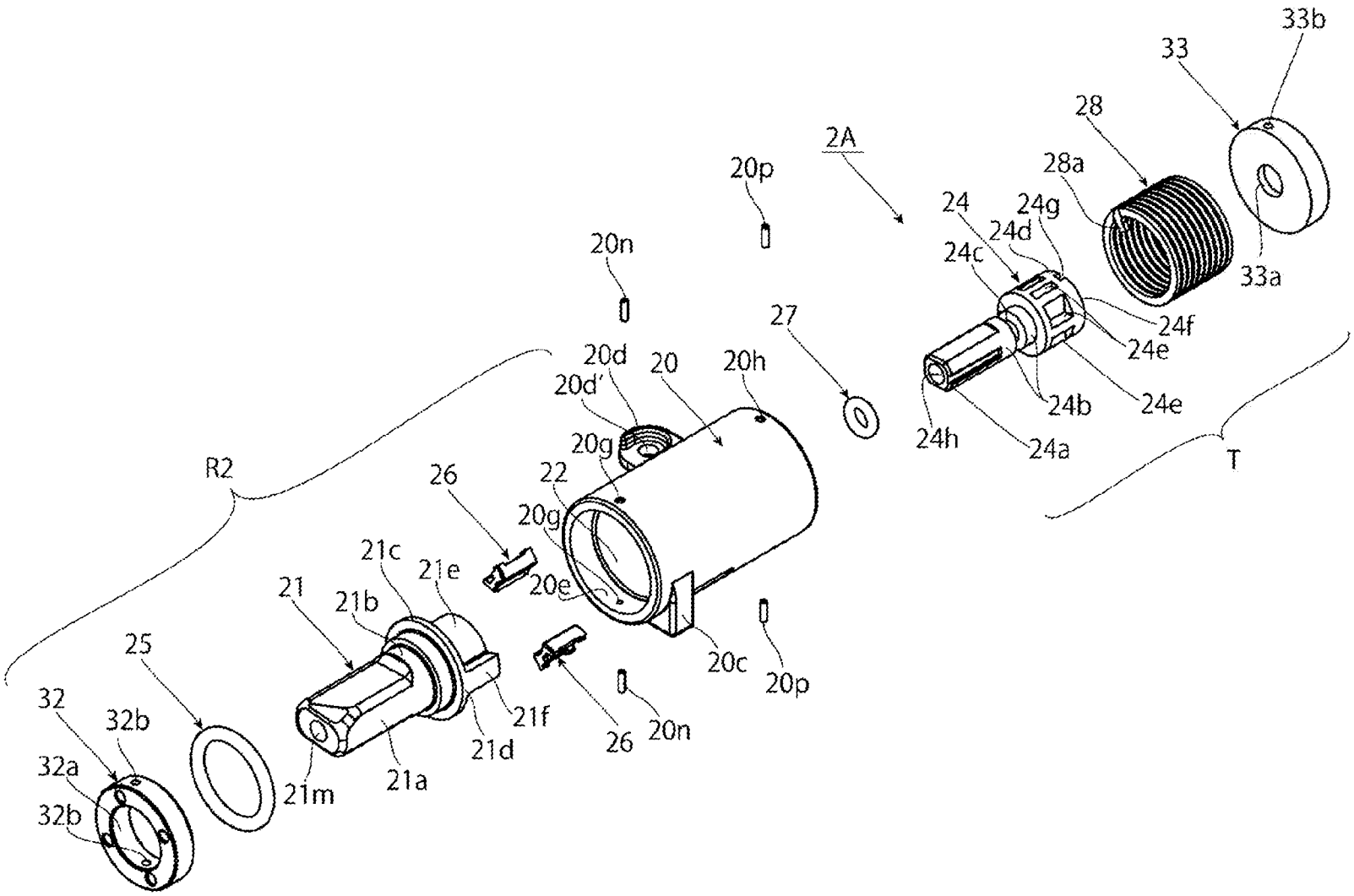
FIG. 11 shows an exploded perspective view of a damper hinge shown in FIG. 9.
Figure 12A:
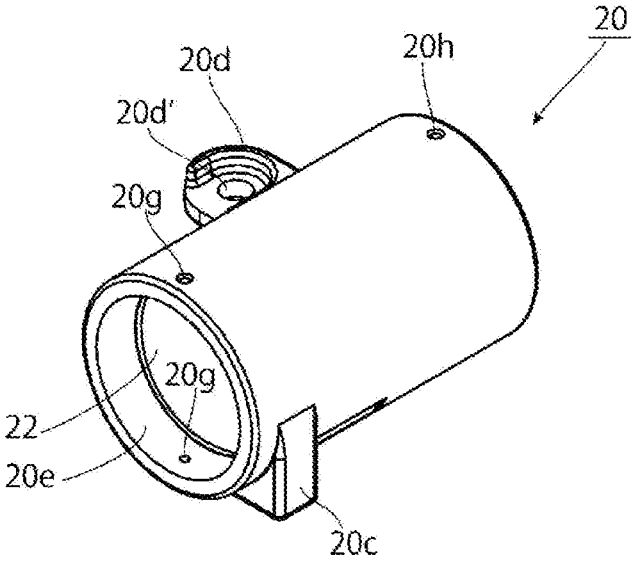
FIGS. 12A to 12C show a cylinder case of a damper hinge as shown in FIG. 9, FIG. 12A being it's a perspective view, FIG. 12B—it's left lateral view, and FIG. 12B—its right lateral view.
Figure 12B:
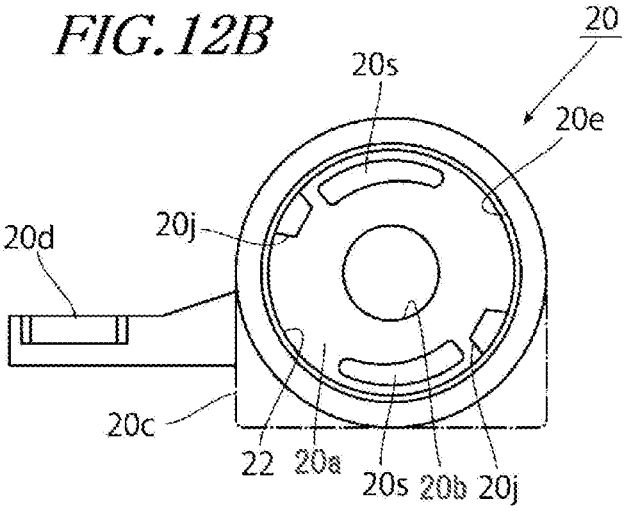
Figure 12C:
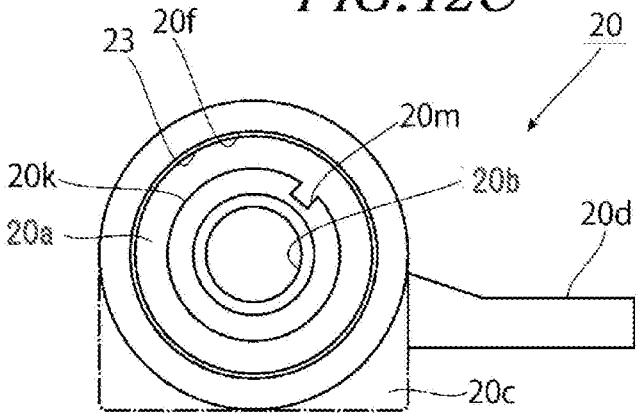

A cylinder case 20 is made of synthetic resin, and its both end sides are open across a partition wall 20*a*; as shown in particular in FIGS. 11 and 12, a first cap attaching hole portion 20*e* and a second cap attaching hole portion 20*f* are provided on its both end portions toward a fluid housing chamber 22 and a torsion housing chamber 23, wherein both have a diameter larger than inner diameters of the fluid housing chamber 22 and the torsion housing chamber 23, a pair of fixing holes 20*g*, 20*g* and a pair of fixing holes 20*h*, 20*h* are provided at an interval of 180 degrees from outside toward the first cap attaching hole portion 20*e* and the second cap attaching hole portion 20*f*, an insertion attaching portion 20*c* is vertically provided downward on one end portion side of its outer circumference, and an attaching portion 20*d* protruding toward one lateral direction on its other end portion side is provided. Moreover, on the fluid housing chamber 22 side, a pair of locking ridges 20*j*, 20*j* are provided at an interval of 180 degrees toward one side in an axial direction from the partition wall 20*a*; a small diameter cylindrical portion 20*k* is integrally provided from the partition wall 20*a* in the torsion housing chamber 23, and a locking groove 20*m* is provided on the small diameter cylindrical portion 20*k* in a radial direction.

Figure 10:
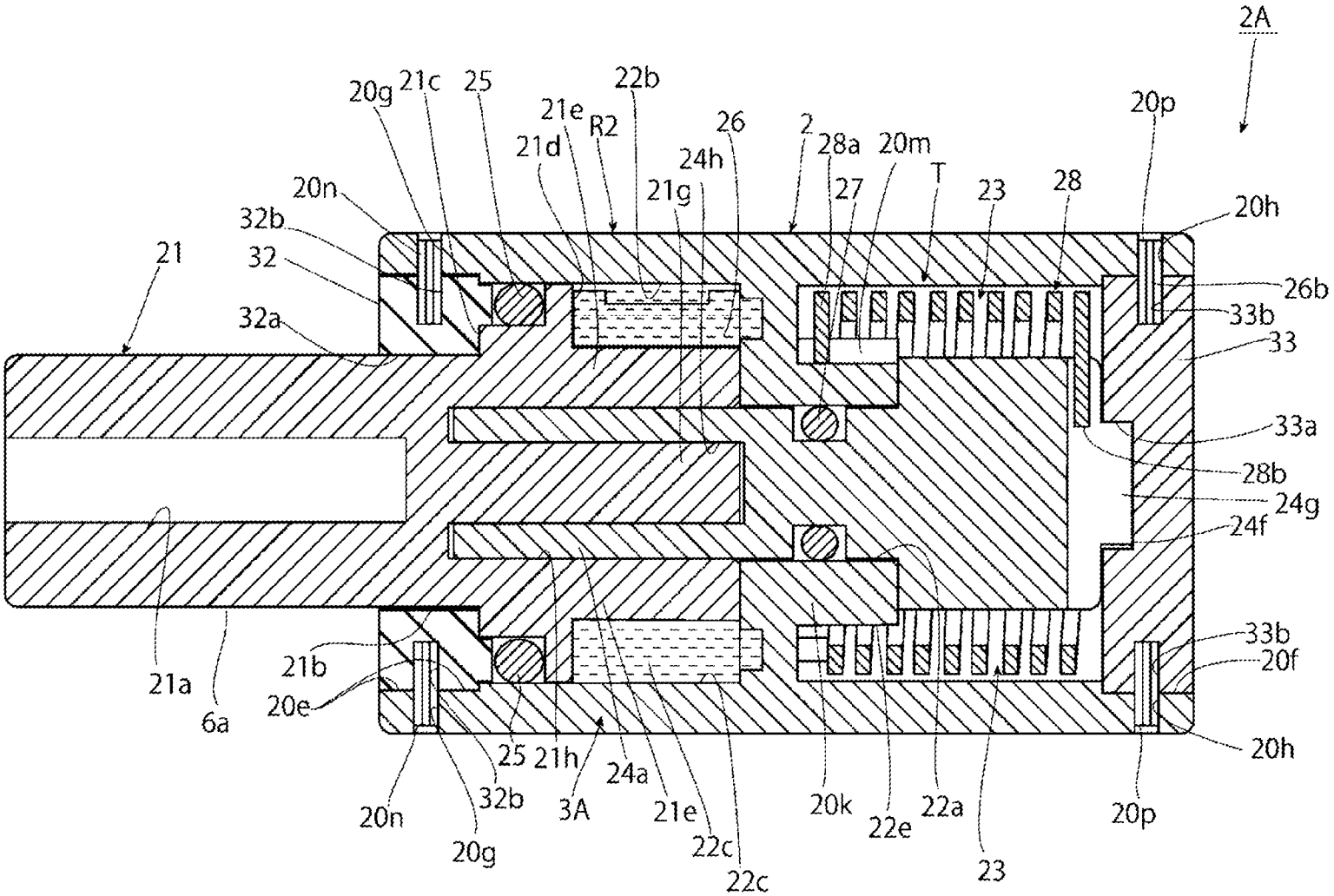
FIG. 10 shows a longitudinal cross section illustrating an inner structure of damper hinge shown in FIG. 9.
Figure 13A:
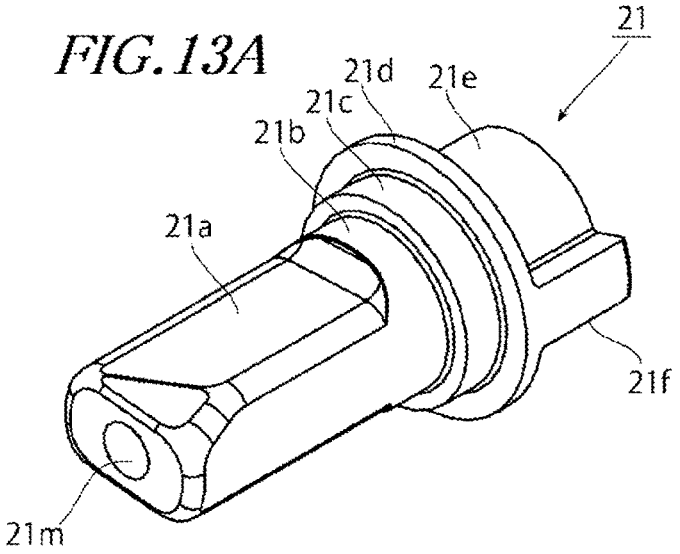
FIGS. 13A to 13C show a rotation shaft of a damper hinge as shown in FIG. 9, FIG. 13A being its perspective view, and FIG. 13B—a left lateral view of FIG. 13A, FIG. 13C—a right lateral view of FIG. 13A.
Figure 13B:
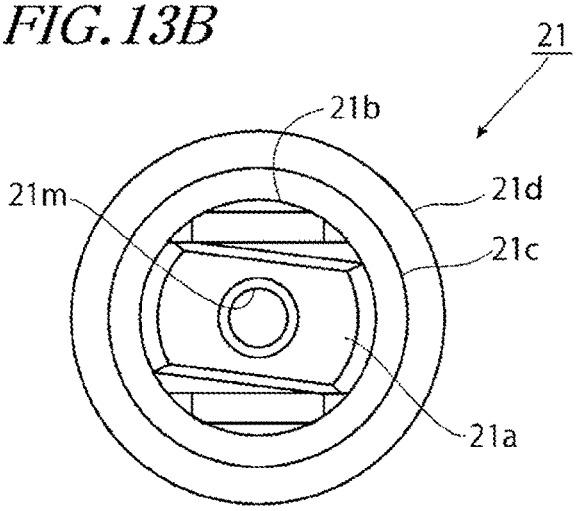
Figure 13C:
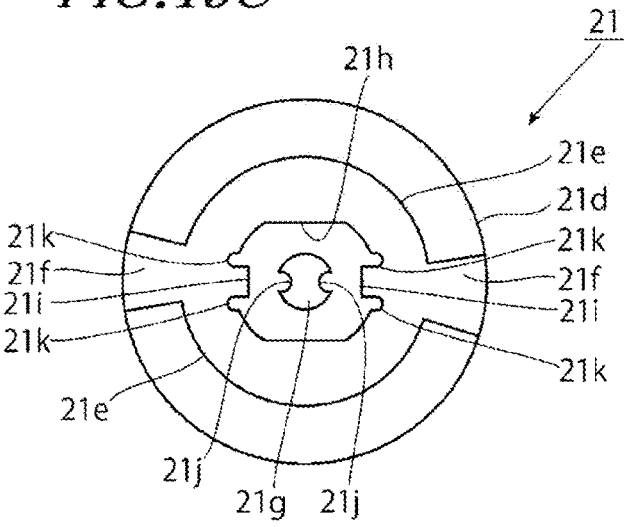
Figure 14A:
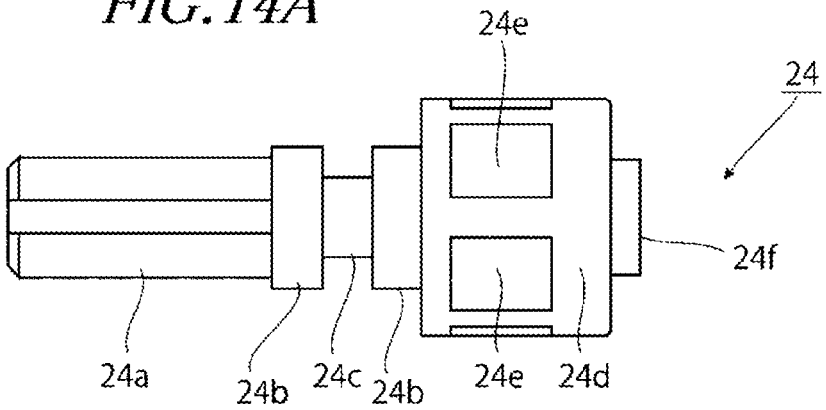
FIGS. 14A to 14D show a link shaft of a damper hinge as shown in FIG. 9, FIG. 14A being an elevation view, FIG. 14B—a its plan view, FIG. 14C-its left side view, and FIG. 14D—its right side view.
Figure 14B:
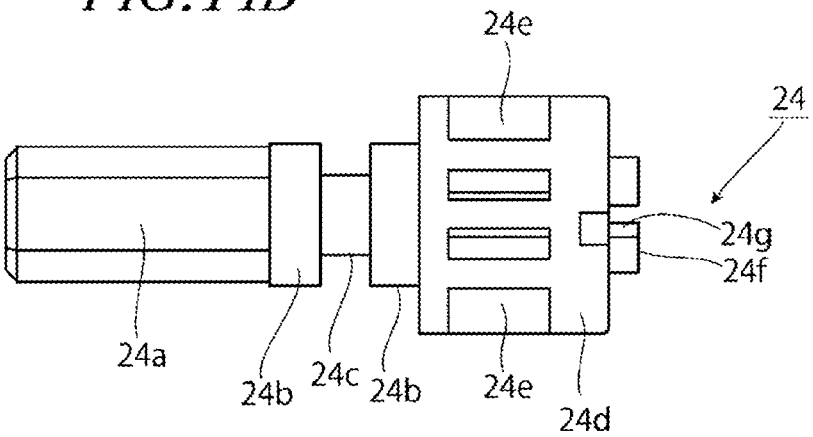
Figure 14C:
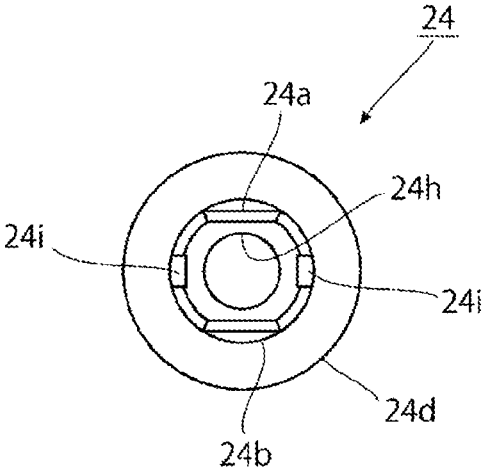
Figure 14D:
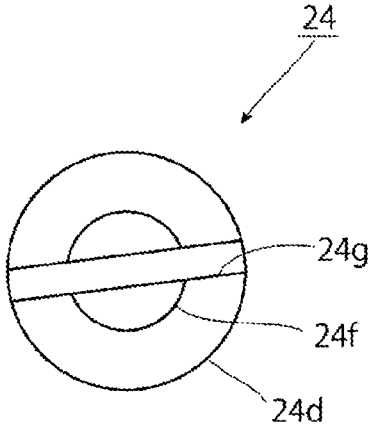

As shown in particular in FIGS. 10, 11 and 13, a rotation shaft 21 comprises an attaching deformed shaft portion 21*a* having a hole portion 21*m* on an axial center in an axial direction on its one end portion, a shaft supporting portion 21*b* provided next to the attaching deformed shaft portion 21*a*, a large diameter portion 21*c* provided next to the shaft supporting portion 21*b*, a flange portion 21*d* provided next to the large diameter portion 21*c*, a medium diameter portion 21*e* provided next to the flange portion 21*d* and having a diameter smaller than the flange portion 21*d*, a pair of blade portions 21*f*, 21*f* provided to protrude at an interval of 180 degrees in a radial direction of the medium diameter portion 21*e*, and a deformed coupling hole 21*h* extending from an end surface of the medium diameter portion 21*e* on an axial center in an axial direction, comprising a coupling shaft portion 21*g* on a central portion and having a substantially rectangular shape, wherein locking ridges 21*i*, 21*i* and gas escape grooves 21*k*, 21*k* are provided on the deformed coupling hole 21*h*, and further gas escape grooves 21*j*, 21*j* are provided on the coupling shaft portion 21*g*. The rotation shaft 21, except an area of the attaching deformed shaft portion 21*a*, is rotatably housed in a fluid housing chamber 22 in a water-tight state as shown in FIG. 10, using a sealing member 25 such as O-ring, wherein the blade portions 21*f*, 21*f* are inserted into the fluid housing chamber 22.

As shown in particular in FIGS. 10, 11 and 13, a link shaft 24 comprises an attaching deformed shaft portion 24*a* inserted into and engaged with a deformed coupling hole 21*h* provided on a rotation shaft 21, a first shaft supporting portion 24*b* provided next to the attaching deformed shaft portion 24*a*, a circumferential groove portion 24*c* provided substantially on a central portion of the first shaft supporting portion 24*b*, a large diameter portion 24*d* provided next to the first shaft supporting portion 24*b*, a second shaft supporting portion 24*f* provided next to the large diameter portion 24*d* and having a diameter smaller than the large diameter portion 24*d*, and a locking groove 24*g* passing through the second shaft supporting portion 24*f* and the large diameter portion 24*d* in a radial direction. On the attaching deformed shaft portion 24*a*, a circular shaft insertion hole 24*h* is provided from its one end portion and locking ridges 24*i*, 24*i* are provided at an interval of 180 degrees on an outer circumference in an axial direction. The link shaft 24 seals a torsion housing chamber 23 from a fluid housing chamber 22, by inserting the first shaft supporting portion 24*b* into a bearing hole 20*b*, making the second shaft supporting portion 24*f* to pivotally support a bearing hole 33*b* provided so as not to pass through a second cap 33 on its axial center in an axial direction, fitting a second sealing member 27 into an area of the circumferential groove portion 24*c* and inserting it into the bearing hole 20*b*.

A first fluid housing chamber 22*a* and a second fluid housing chamber 22*b* are formed in a fluid housing chamber 22, which is partitioned by a medium diameter portion 21*e* provided with a partition wall 20*a*, inner circumferential walls 22*a*, 22*a* and blade portions 21*f*, 21*f* of a rotation shaft 21 as well as valve pieces 26, 26 covering locking ridges 20*j*, 20*j* to be described below.

A fluid damper mechanism R2 is composed of arc-shaped grooves 20*s*, 20*s* respectively provided on a partition wall 20*a* to face a first fluid chamber 22*b* and a second fluid chamber 22*c*, each blade portion 21*f*, 21*f* disposed in the first fluid chamber 22*b* and the second fluid chamber 22*c* and abutting against each inner circumferential wall 22*a*, 22*a*, each valve piece 26, 26 in contact with a medium diameter portion 21*e* of a rotation shaft 21 and fitted onto each locking ridge 20*j*, 20*j*.

A torsion damper mechanism T is composed of a link shaft 24 and a torsion spring 28 wound about the link shaft 24 and resiliently provided between the link shaft 24 and a small diameter cylindrical portion 20*k* of a cylinder case 20.

Still further, a first cap 32 provided with a bearing hole 32*a* on its axial center in an axial direction and with attaching holes 32*b*, 32*b* at an interval of 180 degrees is inserted into a first cap hole 20*e* provided on one open end side of a cylinder case 20, wherein it is attached by spring pins 20*n*, 20*n* from first fixing holes 20*g*, 20*g* into its attaching holes 32*b*, 32*b*; a bearing hole portion 33*a* not passing through is provided on an inner part of a second cap attaching hole portion 20*f* provided on the other end of the cylinder case 20, as shown in FIGS. 10, 11, a second cap 33 provided with attaching holes 33*b*, 33*b* on its outer circumference is inserted, and attached by second fixing holes 20*h*, 20*h* of the cylinder case 20 to its fixing holes.

Figure 15A:
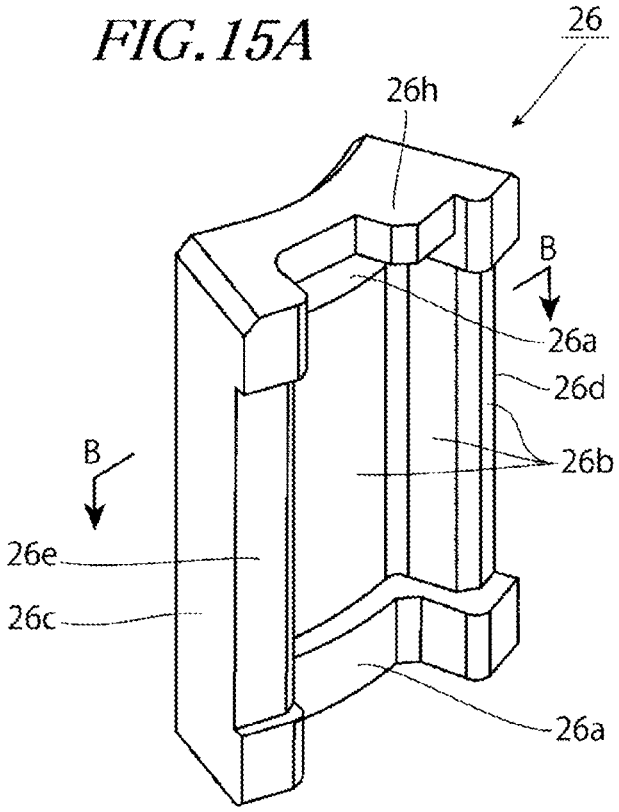
FIG. 15A to 15C show a valve piece of a damper hinge as shown in FIG. 9, FIG. 15A being it's a perspective view, FIG. 15B—its plan view, FIG. 15C—its cross section view in line B-B of FIG. 15A.
Figure 15B:
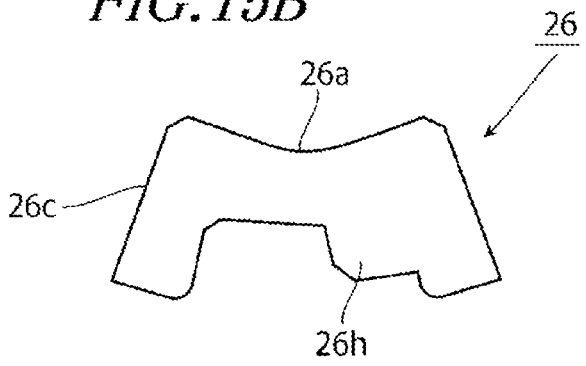
Figure 15C:
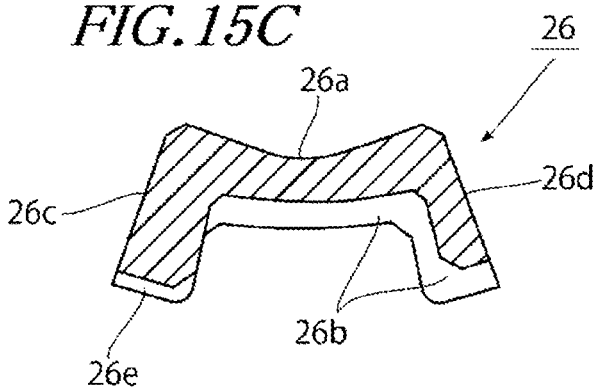

Since each valve piece 26, 26 has an identical structure, reference is made hereinafter to only one of these. Especially as shown in FIG. 15, a valve piece 26 comprises lateral walls 26*c*, 26*d* erected from a base portion 26*a* and has a substantially U-shaped cross section in a direction perpendicular to its extending direction; it is formed to be thinner from a top portion of one lateral portion 26*d* to an inner lateral portion and further to an inner part of a bottom portion 8*a*, so that a groove portion 26*b* is provided and a groove portion 26*e* is provided on a top portion of the other lateral portion 26*c*. Still further, an insertion regulating piece portion is provided on one side edge portion of this valve piece 26, in order to prevent a mistake in direction while fitting it onto a locking ridge 20*j*. When the valve piece 26 is fitted onto the locking ridge 2*g* to engage with it, a gap is generated between both sides of the locking ridge 2*g* and inner parts of the lateral walls 26*c*, 26*d*, the valve piece 26 can rotate by a length of the gap in a circumferential direction relative to the locking ridge 20*j*.

In this case, when a lateral wall 26*c* is in contact with a lateral portion of a locking ridge 2*g*, no gap is generated with the lateral wall 26*c*, so that a first fluid passage 30*a*, 30*a* to be described below is not formed, however, when the lateral wall 26*c* is away from the lateral portion of the locking ridge 2*g*, the groove portion 26*b* is connected with the groove portion 26*e* provided on the top portion of the lateral wall 26*c*. A further fluid passage is also formed by arc-shaped grooves 20*s*, 20*s* and blade portions 21*f*, 21*f*, and referred to as second fluid passage 30*b*, 30*b*. A further fluid passage is also formed by outer lateral bottom surface of a bottom portion 26*a* of the valve piece 26 and a medium diameter portion 21*e* of a rotation shaft 21. This is referred to as third fluid passage 31*a*, 31*a* in the present description.

Next, reference is made to an assembly procedure of the damper hinge 2A according to the invention. First, the assembly has to be conducted following a working procedure, in which a link shaft 24 is built into a torsion housing chamber 23 of a cylinder case 20 together with a torsion spring 28, then a rotation shaft 21 is built into a fluid housing chamber 22 of the cylinder case 20. In this manner, an initial setting for torque value of the torsion spring 28 constituting a one-way rotational urging mechanism can be set even without any special jig, as described below.

Then, for integrating a link shaft 24 into a torsion housing chamber 23 of a cylinder case 20, the link shaft 24 is inserted into a torsion spring 28 of a torsion damper mechanism T from an attaching deformed shaft portion 24*a*, and its locking end 28*b* is inserted into and engaged with a locking groove portion 24*g*. Next, a second sealing member 27 is mounted on a circumferential groove portion 24*c*, and the link shaft 24 is inserted from an open end of the torsion housing chamber 23, until its large diameter portion 24*d* hits on a small diameter cylindrical portion 20*k*, the locking end 28*b* of the torsion spring 28 is inserted and locked by a locking groove 20*m* provided on the small diameter cylindrical portion 20*k* of a partition wall 20*a*. In this manner, the attaching deformed shaft portion 24*a* passes through a bearing hole 20*b* to protrude into the a fluid housing chamber 22, and at the same time, the torsion housing chamber 23 is sealed against the fluid housing chamber 22. Next, a second shaft supporting portion 24*f* of the link shaft 24 is mounted to a bearing hole 33*b* of a second cap 33, a second cap 33 is fitted into a second cap attaching hole portion 20*f*, and spring pins 20P, 20P are pressed into attaching holes 33*b*, 33*b* via fixing holes 20*h*, 20*h* to attach the second cap 33 to the cylinder case 20. In this manner, the link shaft 24 is mounted to the cylinder case 20, with the attaching deformed shaft portion 24*a* holding a predetermined rotation position, as shown in FIG. 17B.

Figure 16A:
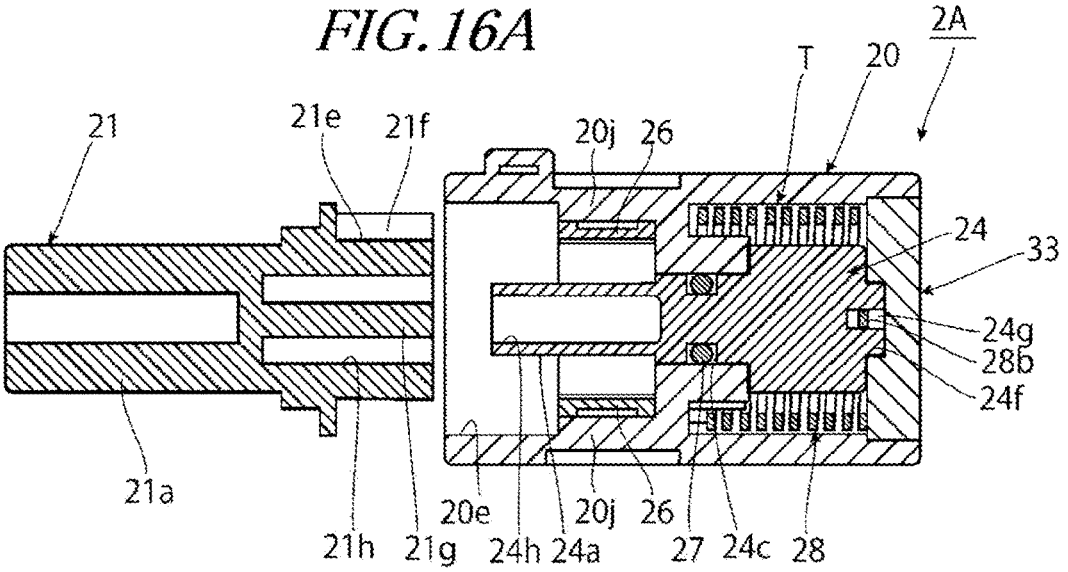
FIGS. 16A and 16C illustrate steps of applying an initial torque to a torsion spring of a torsion damper mechanism, FIG. 16A being a state of a rotation shaft before its insertion into a cylinder case, FIG. 16B—a state of a rotation shaft before its insertion into a cylinder case, and insertion and coupling a rotation shaft, and FIG. 16C—a state of a rotation shaft being rotated from the insertion and coupling state as in FIG. 16B.
Figure 16B:
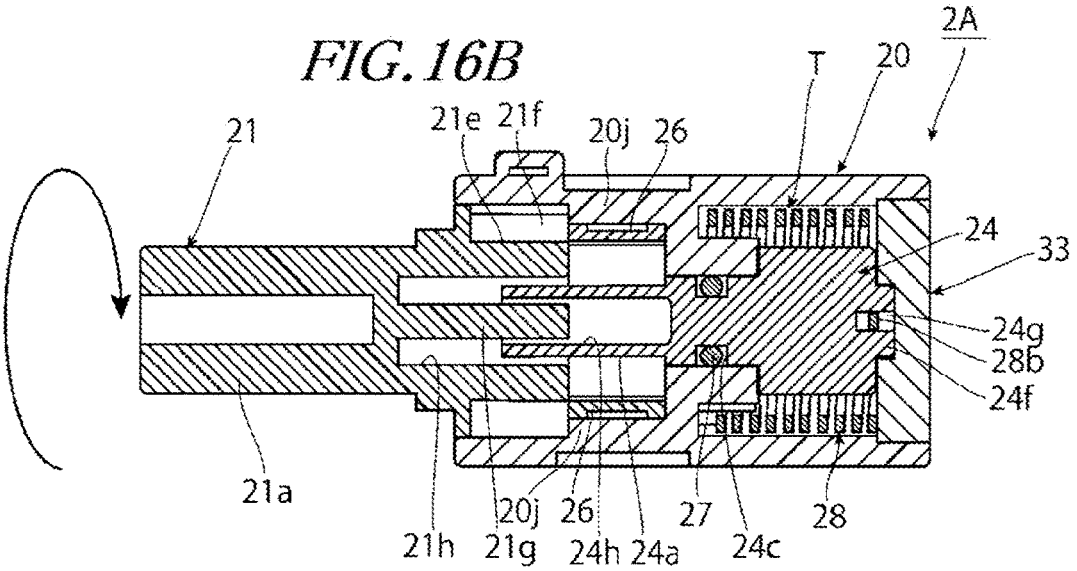
FIGS. 16D and 16E equally illustrate steps of applying an initial torque to a torsion spring of a torsion damper mechanism, FIG. 16D being a state of blade portions of a rotation shaft start to be inserted from the state of FIG. 16C, and FIG. 16E—a state where they are entirely inserted.
Figure 16C:
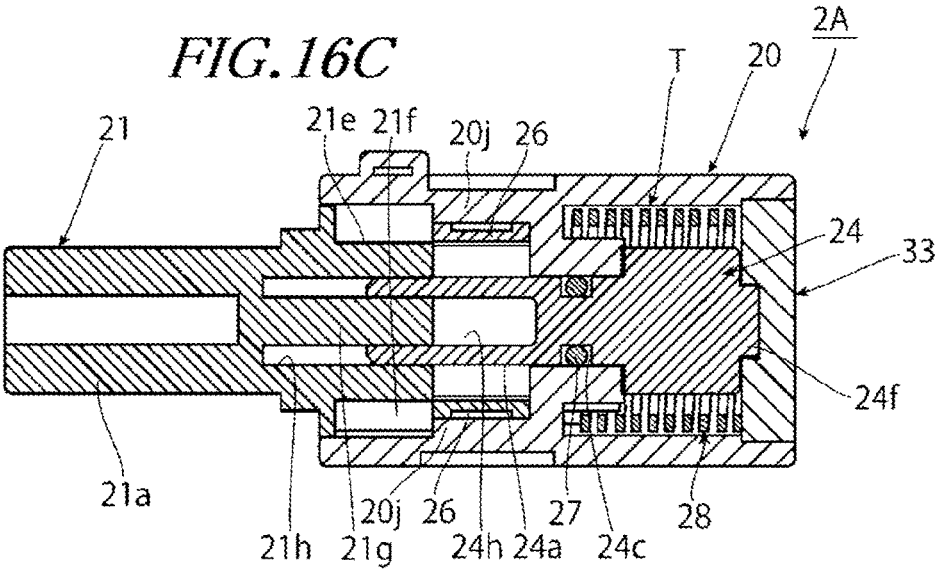
Figure 16D:
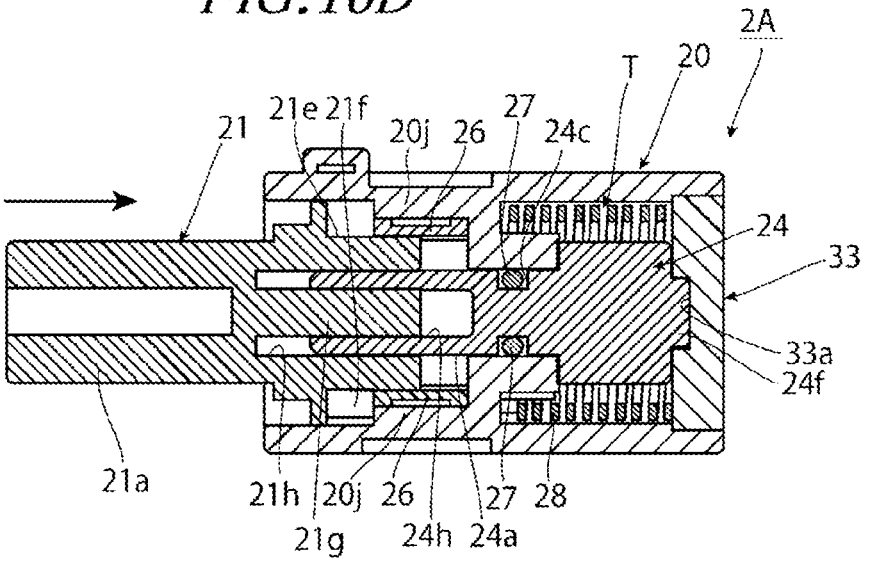
Figure 16E:
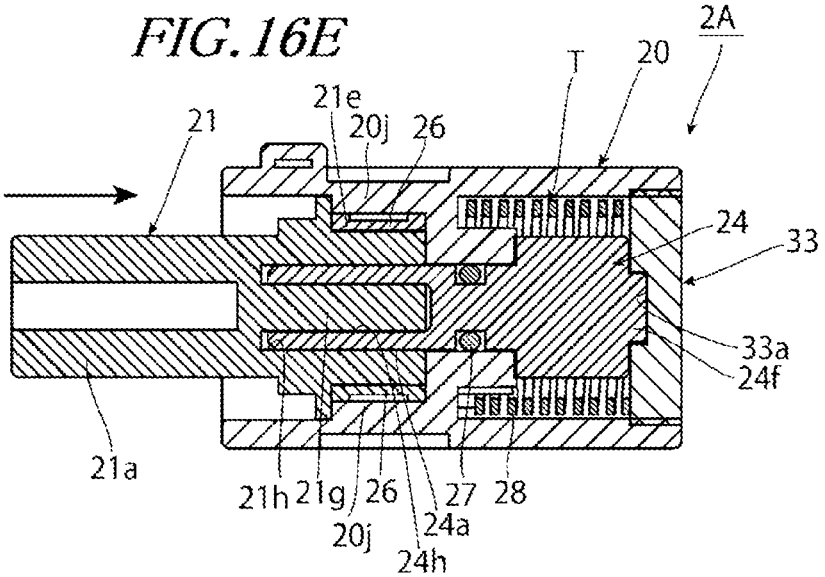
Figure 17A:
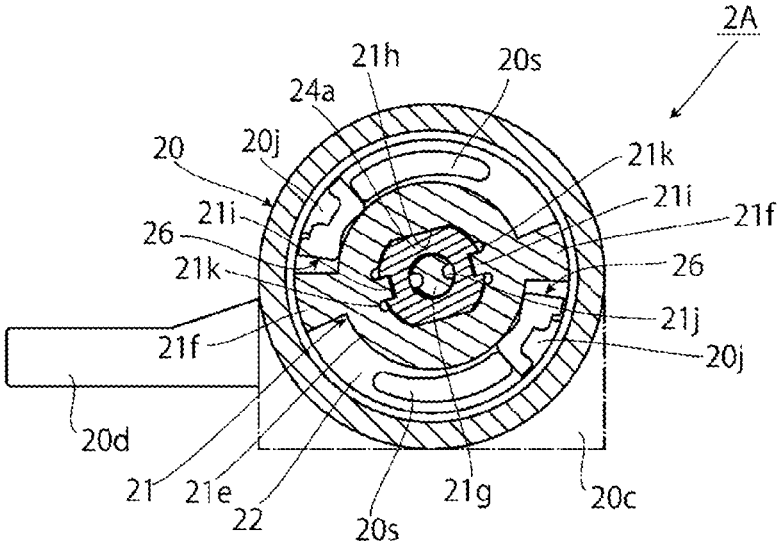
FIGS. 17A and 17B illustrate steps of setting an initial torque to a link shaft, FIG. 17A being a state of a deformed coupling shaft portion of a rotation shaft being inserted into a deformed coupling hole of a rotation shaft, and FIG. 17B—a state where a rotation shaft is rotated, and an initial torque is set to the link shaft.
Figure 17B:
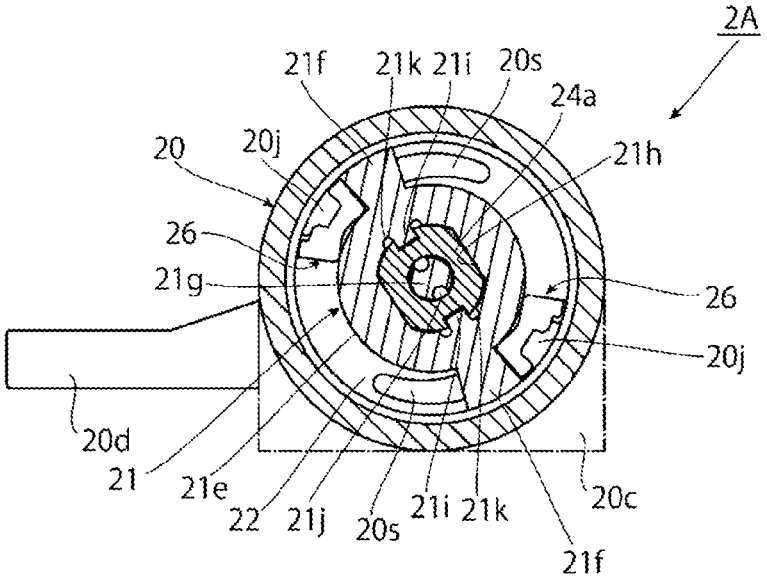

Next, for integrating a rotation shaft 21, after a required amount of damper oil 7 is injected into a fluid housing chamber 22, with a sealing member 25 such as O-ring (not shown) being attached to an outer circumference of a small diameter portion 21*c* of the rotation shaft 21, a blade portion 21*f*, 21*f* of the rotation shaft 21 is inserted into a fluid housing chamber 22 side from the side of the blade portion 21*f*, 21*f*, and an attaching deformed shaft portion 24*a* of a link shaft 24 is inserted into a deformed coupling hole 21*h* of the rotation shaft 21, as shown in FIG. 17A. Next, as shown in FIGS. 16B and 17B, when the rotation shaft 21 is twisted clockwise, the rotation shaft 21 is rotated clockwise as well, and a torsion spring 28 is also caught by the latter in a clockwise movement. In this state, when user's hand is released at a position at which the blade portion 21*f*, 21*f* passes by a valve piece 26, 26 and a locking ridge 20*j*, 20*j*, the torsion spring 28 with a slight twist is inserted into the fluid housing chamber 22, as shown in FIG. 16B, and it presses the rotation shaft and abuts against a partition wall, then his hand is released. Then, the blade portion 21*f*, 21*f* of the rotation shaft 21 stops at the position at which it passes by a valve piece 26, 26, and as the blade portion 21*f*, 21*f* has an outer diameter of the same size as an inner diameter of a cylinder case 20, the blade portion 21*f*, 21*f* is inserted coaxially with the cylinder case 20. Here, before the blade portion 21*f*, 21*f* is inserted into the fluid housing chamber 22, the attaching deformed shaft portion 24*a* of the link shaft 24 is inserted into and engaged with the deformed coupling hole 21*h* of the rotation shaft 21. At this point, when the rotation shaft 21 is rotated, it is caught in the movement via the link shaft 24. Next, as shown in FIG. 17B, when the rotation shaft 21 is inserted into the fluid housing chamber 22 at the position at which the blade portion 21*f*, 21*f* surmounts the valve piece 26, 26 and a locking ridge 20*j*, 20*j*, and thus the user's hand is released, the blade portion 21*f*, 21*f* slightly goes back and stops as it surmounts the valve piece 26, 26, as shown in FIGS. 16A and. 17B. An initial setting for a torque value of the torsion spring 28 is set by this operation.

Next, a first cap 32 is inserted into a first cap attaching hole portion 20*e* of the cylinder case 20, with an axial supporting portion 21*b* of a rotation shaft 21 being inserted into its shaft insertion hole 32*a*; then, since the first cap attaching hole portion 20*e* is a stepped hole as shown in FIG. 12, the cap 32 is mounted into an open end side of the cylinder case 20, without entering too much inside. Here, a first sealing member 25 is deformed to seal a space between a fluid housing chamber 22 and a large diameter portion 21*c* of the rotation shaft 21.

Next, a cap 32 is fixed to a cylinder case 20 using spring pins 20*n*, 20*n*. If it is fixed in this manner, the cylinder case 2 and a rotation shaft 21 are sealed in water-tight state by a first sealing member 25, with a deformed attaching shaft portion 21*a* protruding outside from the cylinder case 20, especially as shown in FIG. 2.

Next, reference is made to an operation of the damper hinge 2A. Especially as shown in FIG. 1, the damper hinge 2A enables the seat 102 to be openably and closably attached to the toilet main body 101, by inserting and fixing the attaching deformed shaft portion 21*a* of the rotation shaft 21 to the deformed attaching hole (not shown) provided on the attaching portion 102*a* of the seat 102, then by fixing the attaching portion 20*c* provided on its cylinder case 20 to the attaching hole (not shown) provided on the toilet main body 101. Though in this embodiment the pair of damper hinges 2A, 2B are used, reference is made in the following to the operation of the only one damper hinge 2A. The damper hinge 2A performs the closing operation for closing the seat 102 from the opened position shown in FIG. 18A to the closed position shown in FIG. 18D, and inversely, the opening operation for opening the seat 102 from the closed position shown in FIG. 18D to the opened position shown in FIG. 18A.

For closing the seat 102 from the fully opened position, since the damper oil 34, 34 circulates via the second fluid passage 30*b*, 30*b* formed by the arc-shaped grooves 20*s*, 20*s* in the first fluid housing chamber 22*a* and the second fluid housing chamber 22*b*, as shown in FIG. 8B, it is smoothly closed. Next, as shown in FIG. 18C, when the second fluid passage 30*b*, 30*b* is closed, the damper oil 34, 34 circulates by the third fluid passage 31*a*, 31*a* between the valve piece 26, 26 and a medium diameter portion 21*e*, so that a smooth closing operation takes place. Then, since the repulsive force of the torsion damper mechanism T increases from a half-way, the seat is not suddenly, but slowly closed.

Figure 18A:
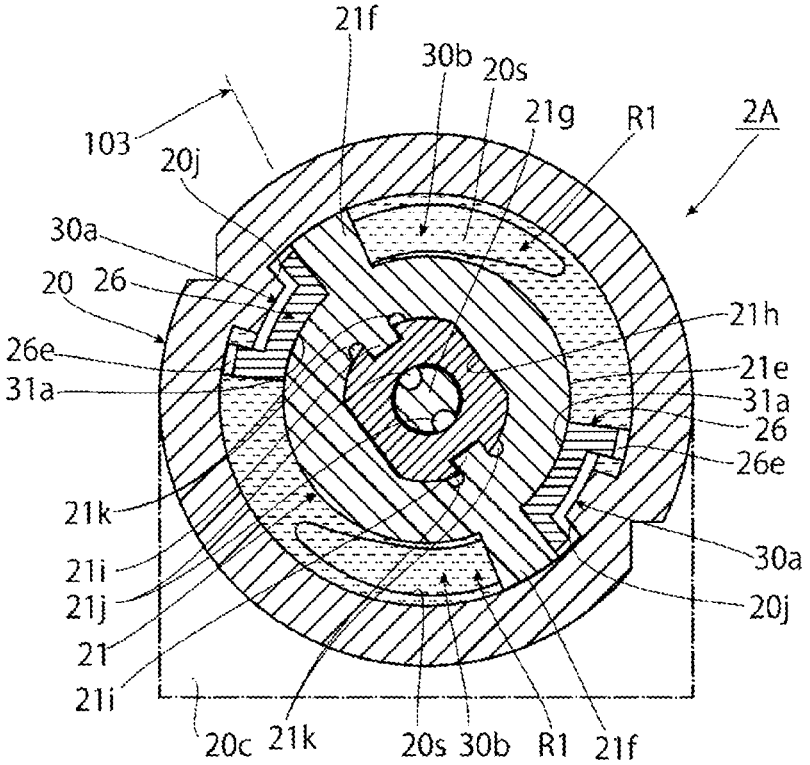
FIGS. 18A and 18B are a longitudinal cross section view of a damper hinge as shown in FIG. 9, FIG. 18A being a fully opened state of a seat lid, and FIG. 18B—a state at the start of its closing.
Figure 18B:
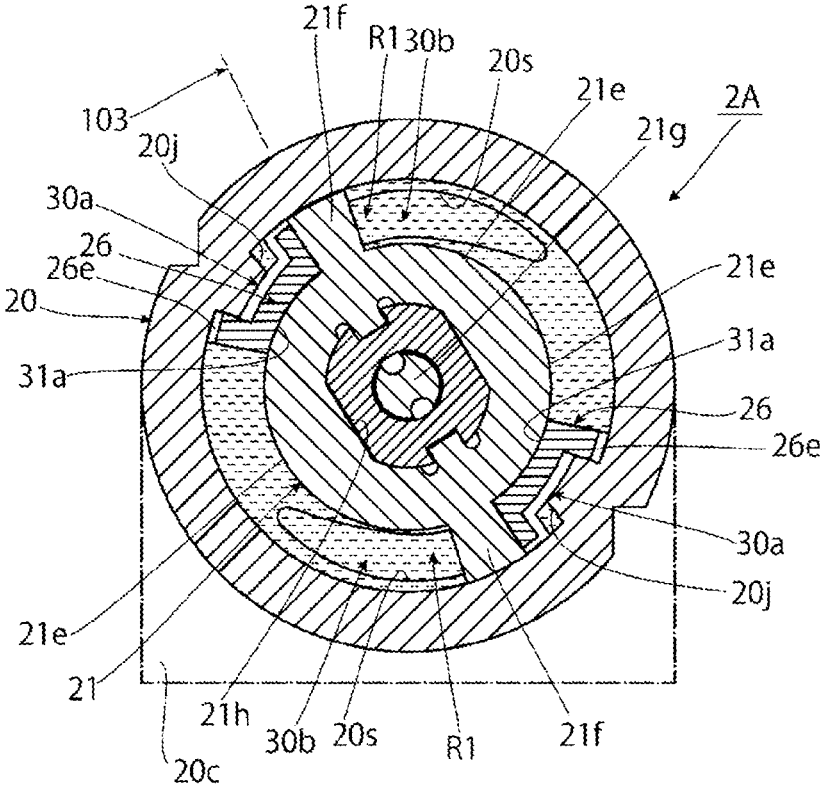
Figure 18C:
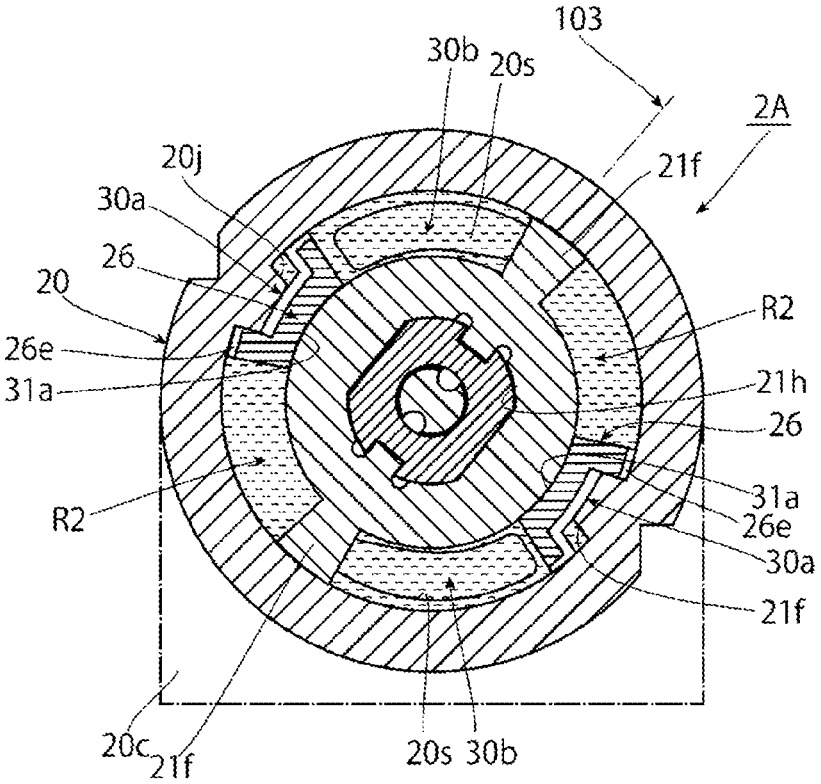
FIGS. 18C and 18D show a longitudinal cross section view of a damper hinge as shown in FIG. 9, FIG. 18C being an intermediate opened state of a seat lid, and FIG. 18D—a fully closed state of a seat lid.

Reference is made in more detail to the opening of the seat 102 from the fully closed state shown in FIG. 18A. In the fully closed state of the seat 102, the blade portion 21*f*, 21*f* is at the start end of the first fluid passage 30*a*, 30*a* and located on one lateral portion side of the valve piece 26, 26, wherein the first fluid passage 30*b*, 30*b* is closed. However, the second fluid passage 30*b*, 30*b* is opened at this point, as shown in the drawings. When the user closes the seat 102 using his/her own hands from the fully opened position, the rotation shaft 21 and the link shaft 24 rotate clockwise in the drawings. First, the second fluid passage 30*b*, 30*b* allows the damper oil 34, 34 the first fluid housing chamber 22*a* and the second fluid housing chamber 22*b* to move from one of the first fluid housing chamber 22*a* and the second fluid housing chamber 22*b* to the other, so that the seat 102 is smoothly closed.

Figure 18D:
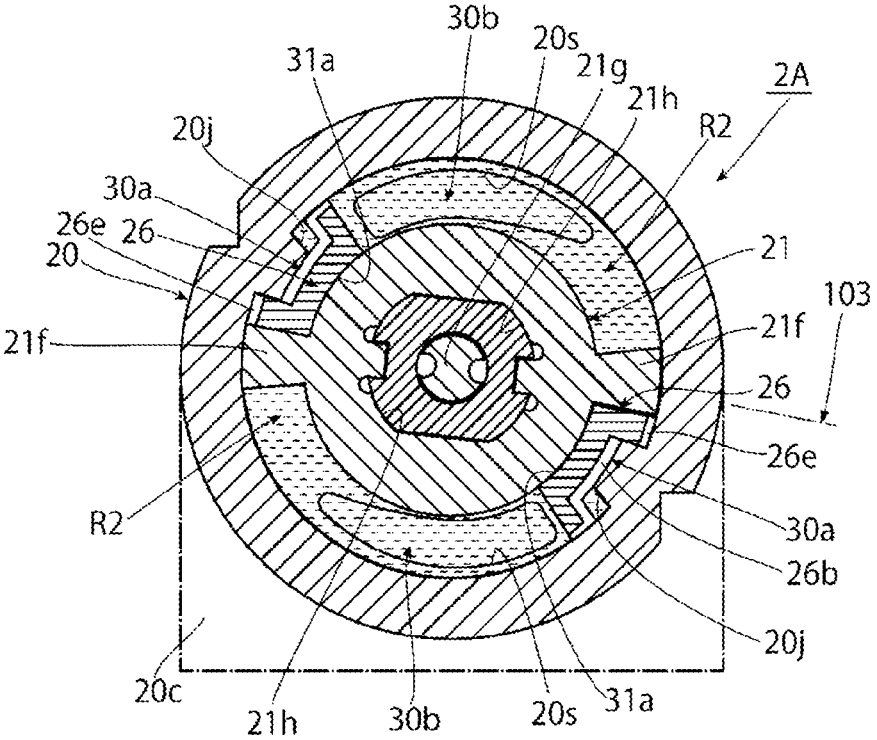

Next, when the seat 102 is further closed, the second fluid housing chamber 22*b* only is closed as shown in FIG. 18C, and the damper oil 34, 34 starts to move only via the third fluid passage 31*a*, 31*a* as described above, and the elastic force of the torsion spring 28 of the torsion damper mechanism T is applied on the link shaft 24, so that the seat 102 is slowly closed to reach the fully closed state as shown in FIG. 18D.

The closed seat 102 can stably maintain its closed state and does not automatically rise up, even with certain oscillations or shaking from outside, since the rotation torque applied on the rotation shaft 21 via the link shaft 24 by the torsion spring 28 of the torsion damper mechanism T is lower than the weight of the seat 102 in this closed state.

Next, reference is made to the opening of the seat 102 from the fully closed state shown in FIG. 18D. When the seat 102 is fully closed, as shown in FIG. 18D, each blade portion 21*f*, 21*f* is located on the lateral portion of each valve member 26, 26 opposed to the one shown in FIG. 18A; however, when the user holds and lifts the front side of the seat 102, the rotation shaft 21 and the link shaft 24 starts to rotate together anticlockwise to allow the opening operation of the seat 102. Here, the damper oil in the first fluid housing chamber 22*b* and the second fluid housing chamber 22*c*, as is pressed by the blade portion 21*f*, 21*f*, flows in a direction opposite to that when closing the seat 102, and the elastic force of the torsion damper mechanism T is applied to assure an easy opening.

When the seat 102 is opened to the intermediate opening angle (60 degrees according to the embodiment) as shown in FIG. 18C, the second fluid passage 30*b*, 30*b* is opened by the further opening operation of the seat 102, so that the elastic force of the torsion spring 28 of the torsion damper mechanism T start to act; in this manner, the seat 102 can be opened with a small operation force or even automatically to reach the fully opened state as shown in FIG. 18A.

The opened seat 102 can stably maintain its opened state and does not automatically close, even with oscillations or shaking from outside to a certain degree, since the blade portion 21*f*, 21*f* provided on the rotation shaft 21 abuts against the valve member 26, 26, and the rotation torque is applied on the rotation shaft 21 in the opening direction of the seat 102 via the link shaft 24 by the torsion spring 28 of the torsion damper mechanism T in this fully opened state.

As in the foregoing, the damper hinge 2A according to the invention can provide a damper hinge with an improved operability as compared to the case of using only the fluid damper mechanism R2 or the torsion damper mechanism T, since the first fluid passage 30*a*, 30*a* is opened and closed from a half way, and the third fluid passage 31*a*, 31*a* operates as necessary to modify the rotation torque of the fluid damper mechanism R2.

In the meantime, the fully opened angle for the seat 102 is 120 degrees, but the invention is not limited hereto. The fully opened angle can be fittingly set. For example, for urination, the seat 102 and the seat lid 103 need not be opened to the fully opened position, i.e. an angle greater than 90 degrees, but can be stopped and held at 60 or 70 degrees.

Furthermore, the damper hinge as described above in Embodiment 2 is used as a hinge for opening and closing the seat and the seat lid for the western-style toilet, but the invention is not limited hereto. As mentioned above, it is widely applied, when it is necessary to buffer an opening and closing body in its opening and closing, as well as when it is necessary to hold the opening and closing body in its self-standing state. For example, various opening and closing bodies for electric appliances, a cabinet, an opening and closing display body for OA equipment, etc. can be listed.

Embodiment 3

Figure 19:
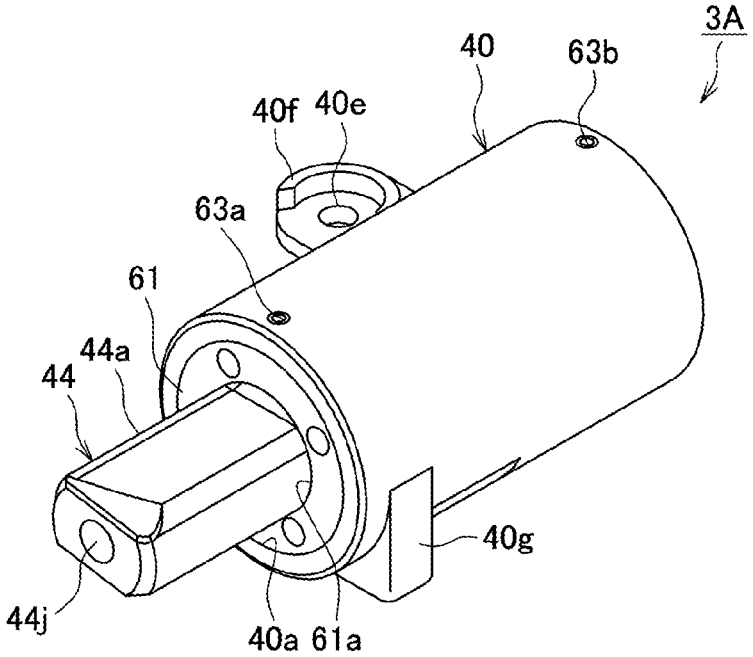
FIG. 19 shows a perspective view of a damper hinge according to Embodiment 3.

FIG. 19 shows a damper hinge according to Embodiment 3. The damper hinge 3A according to Embodiment 3 is the other embodiment of a damper hinge 2A according to Embodiment 2. In the following, the damper hinge 3A according to Embodiment 3 is explained in detail, based on drawings. In the following, a damper hinge 3A of Embodiment 3 is described as a hinge used for opening and closing a seat lid of western-style toilet, however, the damper hinge according to the invention is not limited hereto, but can be used for opening and closing an opening and closing body such as seat, or a lid body for various electric appliances or a cabinet, etc. Therefore, for this reason, hereinafter an opening and closing body is referred to as seat, but as opening and closing body in claims.

As shown in FIGS. 19 to 30D, the damper hinge 3A according to the invention comprises a cylinder case 40 having a partition wall 60 provided with a first bearing hole 60*a* passing through an axial center in an axial direction substantially on a central portion in its inside, a rotation shaft 21 rotatably attached in water-tight state in a fluid housing chamber 40A provided on one side between the partition wall 60 of the cylinder case 40 and a valve member 42 fixed to one lateral portion side, a link shaft 46 attached in water-tight state in a torsion housing chamber 40B provided on the other side across the partition wall 60 to be rotatable together with the rotation shaft 44, a fluid damper mechanism 43A provided on the rotation shaft 44 side, and a torsion damper mechanism 43B consisting of a torsion spring 47 provided on the link shaft 46 side.

Figure 20:
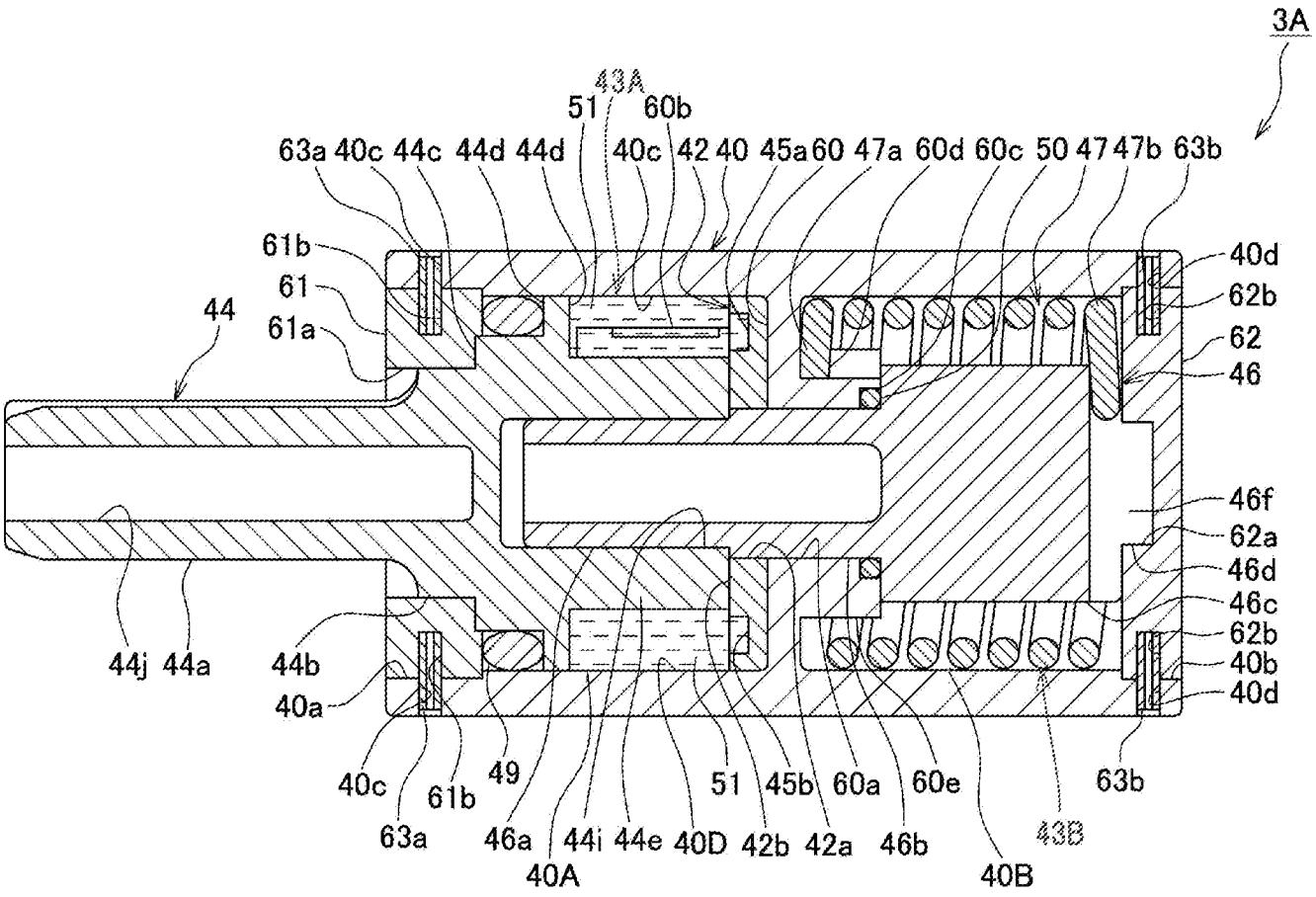
FIG. 20 shows a longitudinal cross section view of a damper hinge shown in FIG. 19.
Figure 22A:
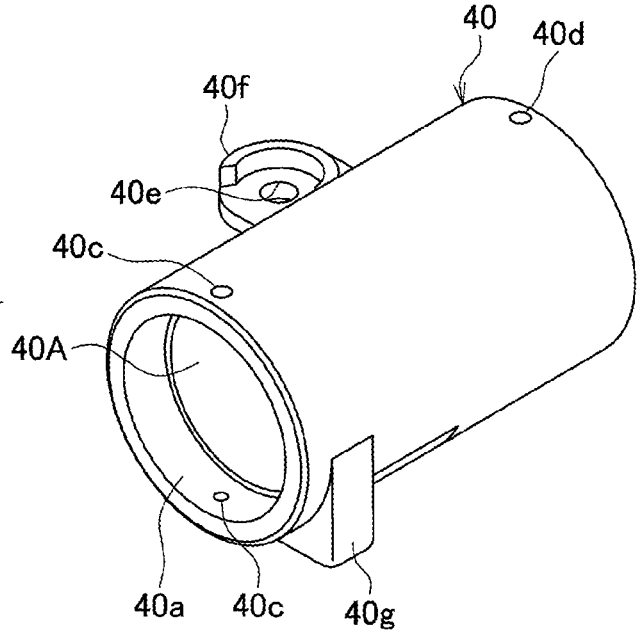
FIG. 22A to 22C show a cylinder case of a damper hinge as shown in FIG. 19, FIG. 22A being its perspective view, FIG. 22B—its left side view of FIG. 22A, and FIG. 22C—its right side view of FIG. 22A.
Figure 22B:
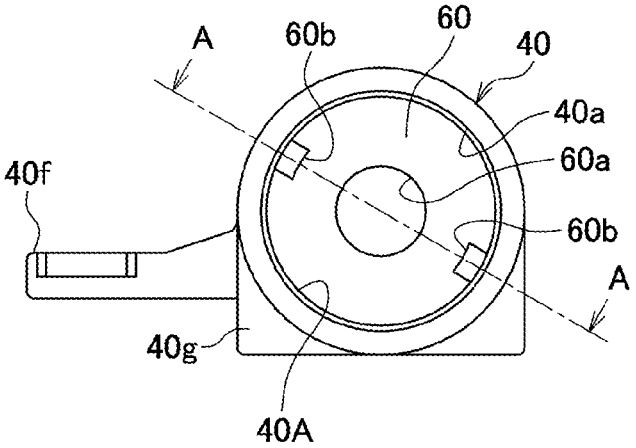
Figure 22C:
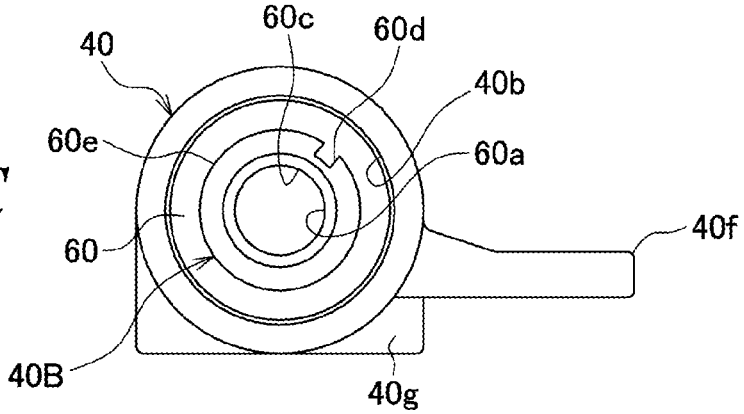
Figure 23:
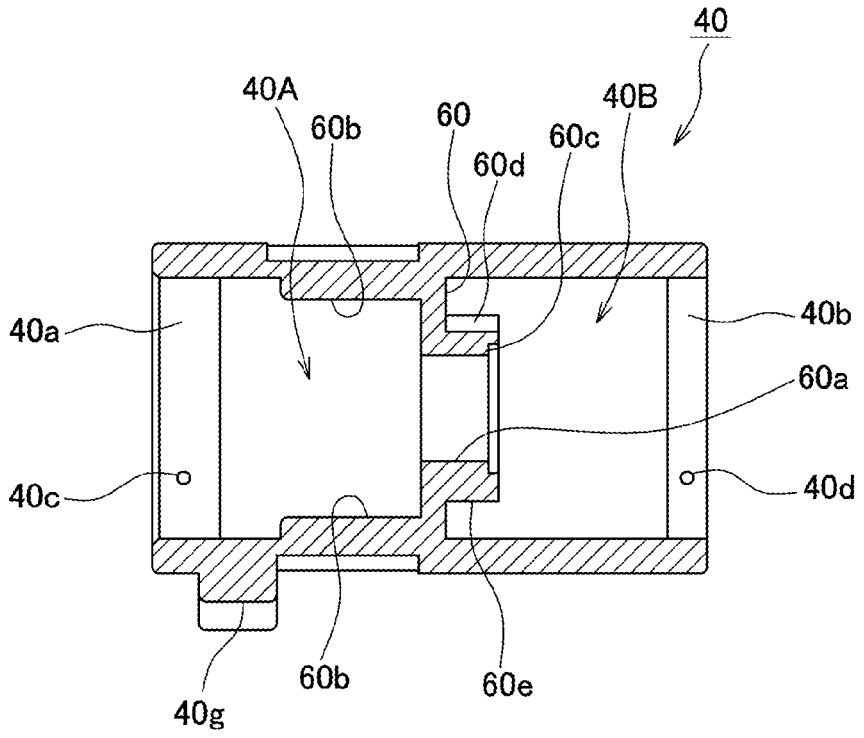
FIG. 23 shows a cylinder case of a damper hinge as shown in FIG. 19, being—its longitudinal cross section view.

A cylinder case 40 is made of synthetic resin, and its both end sides are open; as shown in particular in FIGS. 20 and 22, a first attaching hole portion 40*a* and a second attaching hole portion 40*b* of a slightly larger diameter are provided on its both end portions toward a fluid housing chamber 40A and a torsion housing chamber 40B, a pair of first cap attaching hole portions 40*c*, 40*c* and a pair of second cap attaching hole portions 40*d*, 40*d* are provided at an interval of 180 degrees from outside toward the first attaching hole portion 40*a* and the second attaching hole portion 40*b*, an insertion attaching piece 40*g* is vertically provided downward on one end portion side of its outer circumference, and an attaching piece 40*f* protruding toward one lateral direction on its other end portion side and having an attaching hole 40*e* is provided. Moreover, on the fluid housing chamber 40A side, a pair of locking ridges 60*b*, 60*b* are provided at an interval of 180 degrees toward one side in an axial direction from the partition wall 60, as shown in FIGS. 22B and 23; a small diameter cylindrical portion 60*e* comprising a circumferential groove 60*c* on an inner circumference integrally provided from the partition wall 60 and provided with a locking groove 60*d* for locking one end portion 47*d* of the torsion spring 47 of a torsion damper mechanism 43B to be described below on an outer circumference is provided in the torsion housing chamber 40B, wherein a first bearing hole 60*a* passes through the small diameter cylindrical portion 60*e*.

In a fluid housing chamber 40A, a disc-shaped valve member 42 comprising an outer circumferential portion in contact with an inner circumference of the fluid housing chamber 40A and a second bearing hole 42*a* on its axial center in an axial direction is rotatably provided. As shown in particular in FIG. 25, on the valve member 42, a pair of valve piece portions 42*c*, 42*d* are provided at an interval of 180 degrees toward its one lateral side, and on a surface portion 42*b* on the side provided with the valve piece portions 42*c*, 42*d* and across the second bearing hole 42*a*, a pair of arc-shaped grooves 45*a*, 45*b* not passing through the surface portion 42*b* and having an arc-shape are provided between respective valve piece portions 42*c*, 42*d*. In these arc-shaped grooves 45*a*, 45*b*, start end portions 45*c*, 45*d* extend from base portions of respective valve piece portions 42*c*, 42*d*, and the grooves become narrower midway of the surface portion 42*b* to be terminal portions 45*e*, 45*f* and end at this point.

Figure 21:
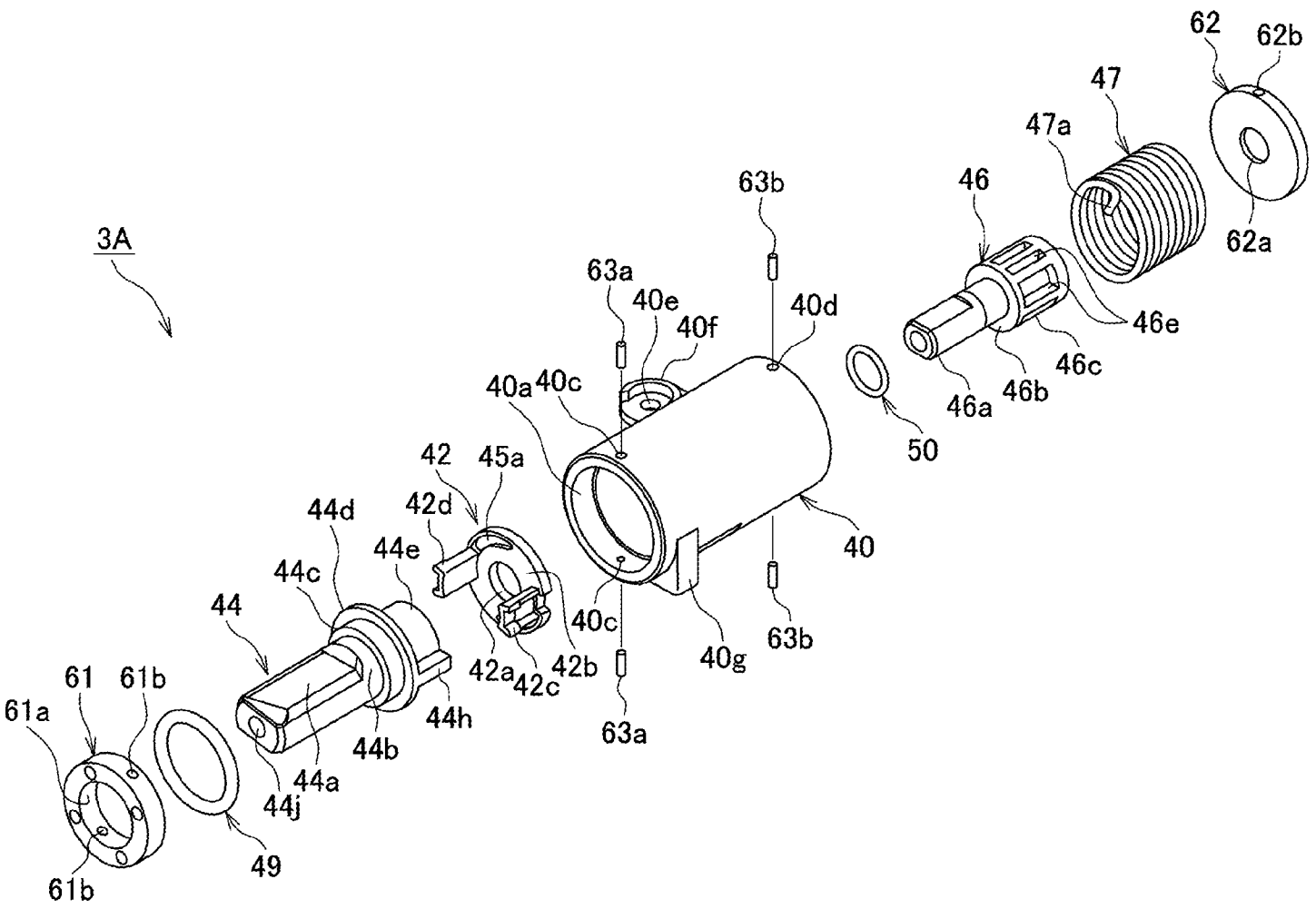
FIG. 21 shows an exploded perspective view of a damper hinge shown in FIG. 19.
Figure 24A:
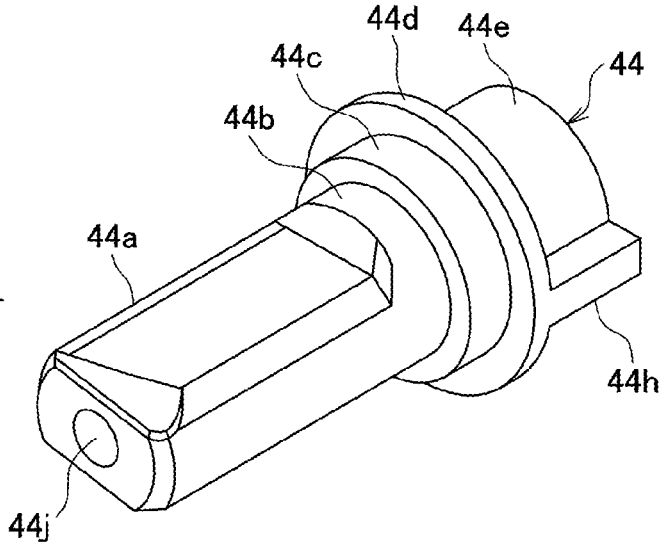
FIGS. 24A to 24C show a rotation shaft of a damper hinge as shown in FIG. 19, FIG. 24A being its perspective view, FIG. 24B—its left lateral view, and FIG. 24C—its right lateral view.
Figure 24B:
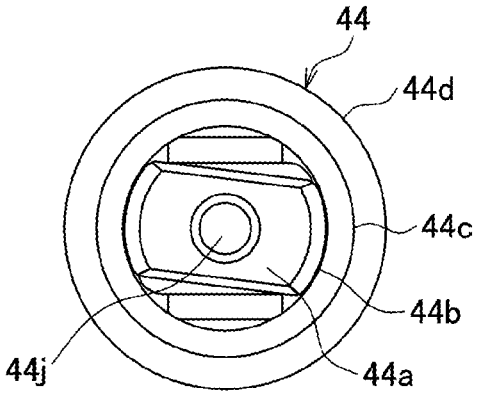
Figure 24C:
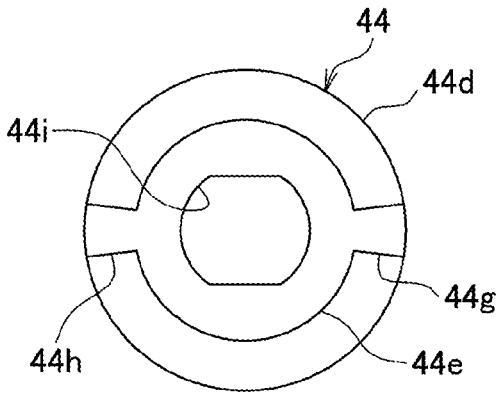

As shown in particular in FIGS. 21 and 24, a rotation shaft 44 comprises an attaching deformed shaft portion 44*a* on its one end portion, a shaft supporting portion 44*b* provided next to the attaching deformed shaft portion 44*a*, a large diameter portion 44*c* provided next to the shaft supporting portion 44*b*, a flange portion 44*d* provided next to the large diameter portion 44*c*, a medium diameter portion 44*e* having a smaller diameter than the flange portion 44*d*, a pair of blade portions 44*g*, 44*h* provided to protrude at an interval of 180 degrees in a radial direction of the medium diameter portion 44*e*, and a deformed coupling hole 44*i* having a substantially elliptic cross section on its axial center in an axial direction. The rotation shaft 44, except an area of the attaching deformed shaft portion 5*a*, is rotatably housed in the fluid housing chamber 40A in a water-tight state, as described below, as shown in FIG. 20, wherein the blade portions 44*g*, 44*h* are inserted between respective valve piece portions 42*c*, 42*d* and an end surface of the medium diameter portion 44*e* presses against a surface portion 42*b* of a valve member 42.

Figure 27:
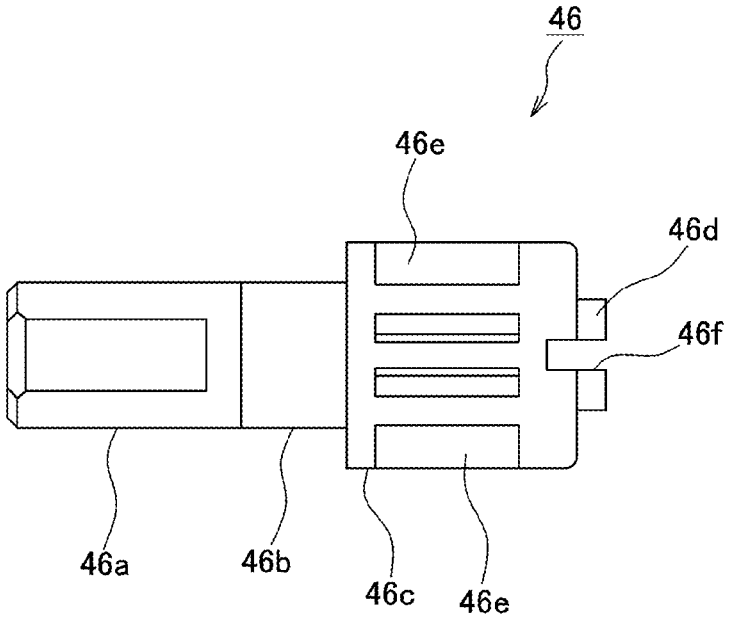
FIG. 27 shows a plan view of a link shaft of a damper hinge shown in FIG. 19.
Figure 28A:
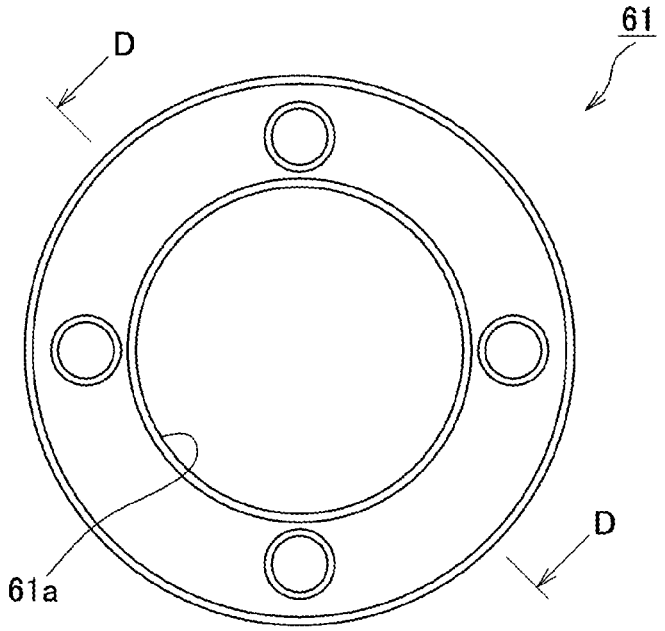
FIGS. 28A and 28B show a first cap of a damper hinge as shown in FIG. 19, FIG. 28A being its left lateral view, and FIG. 28B—its cross section in line D-D of FIG. 28A.
Figure 28B:
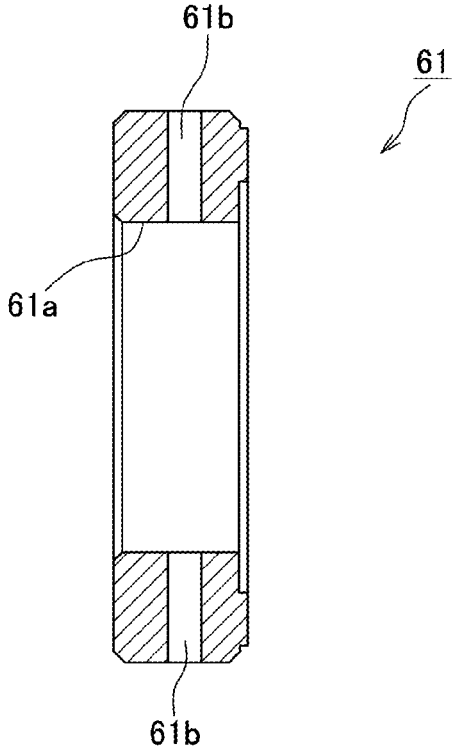

As shown in particular in FIGS. 21 and 27, a link shaft 46 comprises an attaching deformed shaft portion 46*a* inserted into and engaged with a deformed coupling hole 44*i* provided on a rotation shaft 44, a first shaft supporting portion 46*b* provided next to the attaching deformed shaft portion 46*a*, a large diameter portion 46*c* provided next to the first shaft supporting portion 46*b*, and a second shaft supporting portion 46*d* provided next to the large diameter portion 46*c* and having a diameter smaller than the large diameter portion 46*c*, wherein the link shaft is housed in a torsion housing chamber 40B to be rotatable in water-tight state together with the rotation shaft 44, as described below. Moreover, a plurality of concave portions 46*e* are radially formed on an outer circumference of the large diameter portion 46*c*, and a locking groove 46*f* passing through in a radial direction of the second shaft supporting portion is provided on the second shaft supporting portion 46*d*.

Figure 29A:
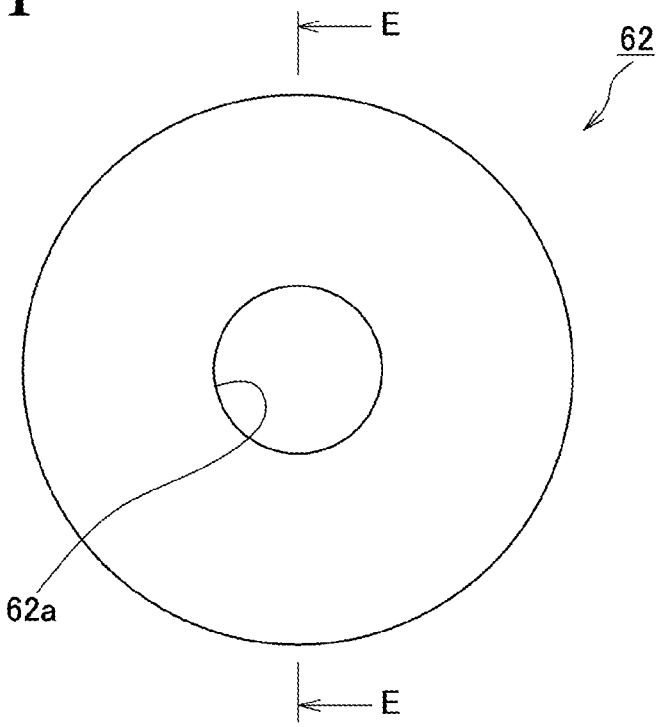
FIGS. 29A and 29B show a second cap of a damper hinge as shown in FIG. 19, FIG. 29A being its left lateral view, and FIG. 29B—its cross section in line E-E of FIG. 29A.
Figure 29B:
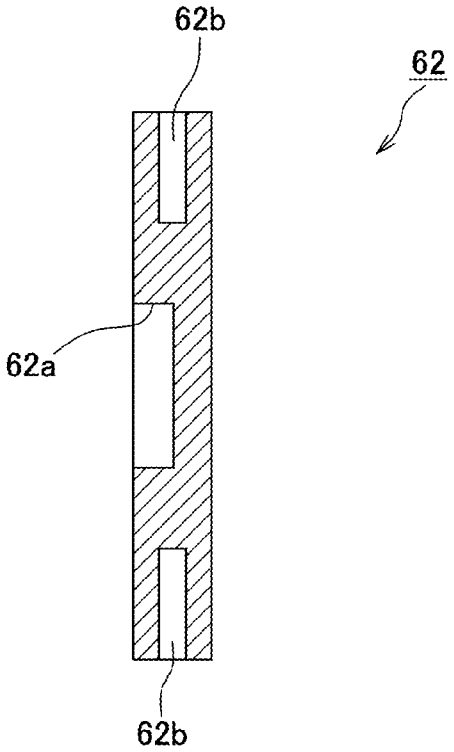

Still further, a first cap 61 provided with a bearing hole 61*a* on its axial center in an axial direction and with attaching holes 61*b*, 61*b* at an interval of 180 degrees is inserted into a first cap hole portion 40*a* provided on one open end side of a cylinder case 40, wherein it is attached by spring pins 63*a*, 63*a* pressed from first attaching hole portions 40*c*, 40*c* into its attaching holes 61*b*, 61*b*; as shown in FIG. 29, a second cap 62 provided with a bearing hole portion 62*a* not passing through on its axial center on an inner part, as well as with attaching holes 62*b*, 62*b* at an interval of 180 degrees on its outer circumference is inserted into a second cap attaching hole portion 40*b* provided on the other open end of the cylinder case 40, and attached by spring pins 63*b*, 63*b* pressed from second fixing holes 40*d*, 40*d* to its attaching holes 62*b*, 62*b*.

Figure 25A:
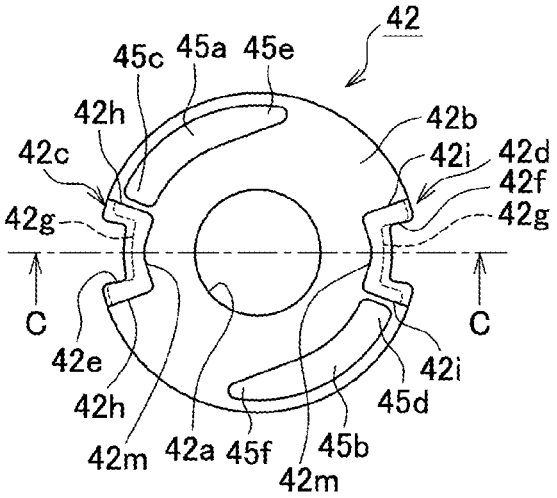
FIGS. 25A and 25B show a valve member of a damper hinge as shown in FIG. 19, FIG. 25A being its left lateral view, and FIG. 25B—its perspective view seen from one side of FIG. 25A.
Figure 25B:
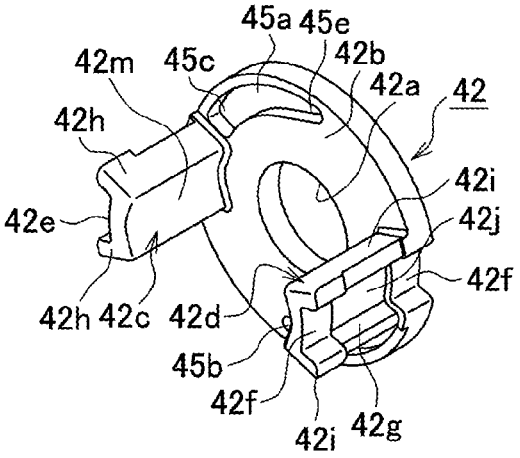
Figure 25C:
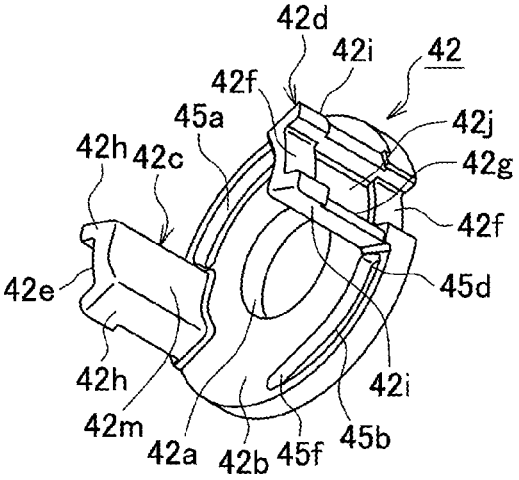
FIGS. 25C and 25D show a valve member of a damper hinge as shown in FIG. 19, FIG. 25C being a perspective view as seen from other side of FIG. 25A, and FIG. 25D—its cross section view in line C-C of FIG. 25A.
Figure 25D:
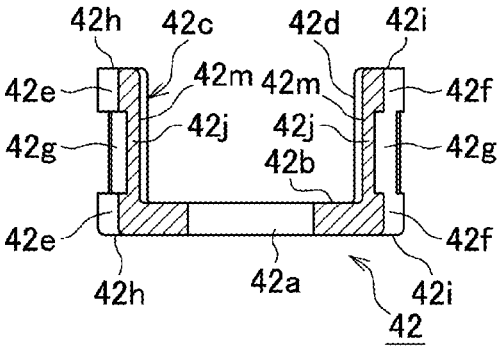
Figure 26A:
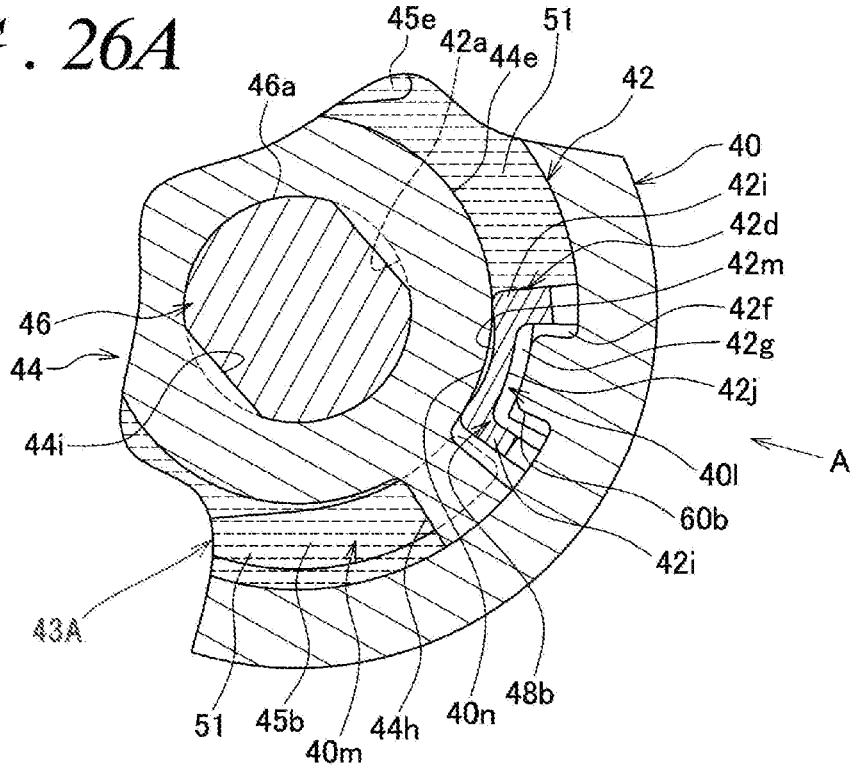
FIGS. 26A and 26B are views illustrating a first passage of a damper hinge as shown in FIG. 19, FIG. 26A being its sectional side elevation, and FIG. 26B—its cross section view as seen from arrow A showing FIG. 26A.
Figure 26B:
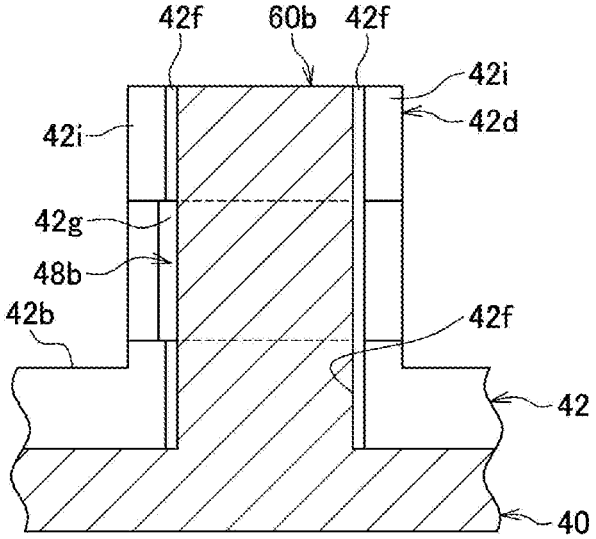
Figure 30A:
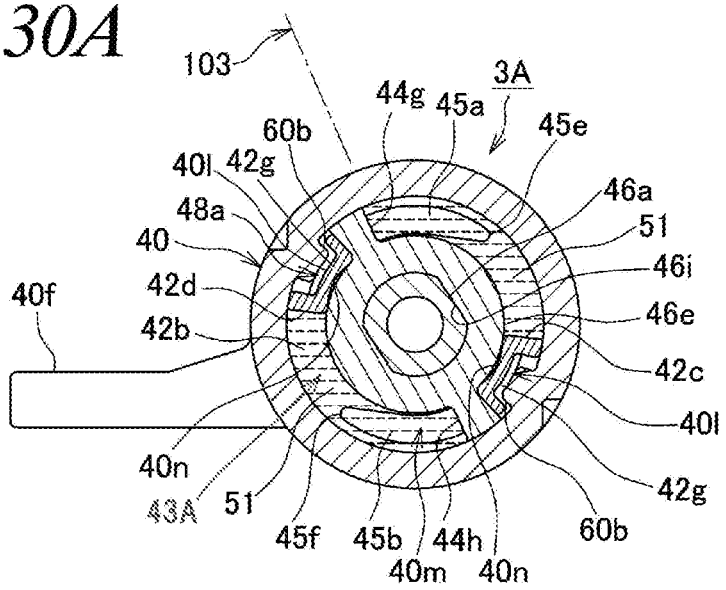
FIGS. 30A and 30B are a longitudinal cross section of a damper hinge as shown in FIG. 19, FIG. 30A being a fully opened state of a seat lid, and FIG. 30B—a state at the start of its closing.
Figure 30B:
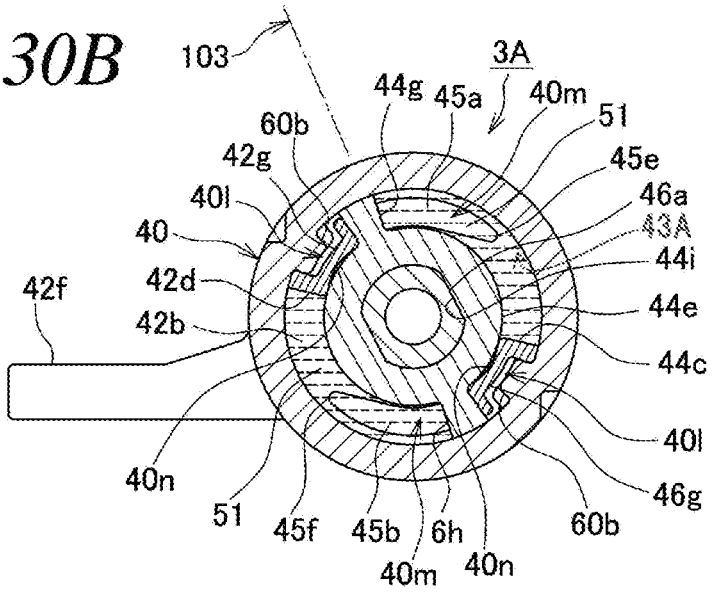

To describe in more detail an area in which a valve member 42 is attached to a partition wall 60 of a cylinder case 40, each valve piece portion 42*c*, 42*d* has a substantially U-shaped cross section in a direction perpendicular to its extending direction from a surface portion 42*b*, as shown in particular in FIGS. 25A, 25B, and comprises attaching groove portions 42*f*, 42*f* and fluid guide groove portions 42*g*, 42*g* provided between respective attaching groove portions 42*f*, 42*f* and wider than these attaching groove portions 42*f*, 42*f*. Each of these fluid guide groove portions 42*g*, 42*g* has in common a portion provided on the top of both wall portions 42*h*, 42*i*; 42*h*, 42*i* constituting the attaching groove portions 42*f*, 42*f*; however, this is not provided on one 42*h*, 42*h* of the both wall portions 42*h*, 42*i*; 42*h*, 42*i*, but on the inside of the other 42*i*, 42*i* and on a bottom surface portion 42*j*, 42*j*. Locking ridges 60*b*, 60*b* are fitted into attaching groove portions 42*f*, 42*f* on both lateral portions of each valve piece portion 42*c*, 42*d* and fluid guide groove portions 42*g*; however, there are gaps 42*k*, 42*k* between an inner width of the attaching groove portions 42*f*, 42*f* and an outer width of the locking ridges 60*b*, 60*b*, and due to such gaps, the valve member 42 is rotated in forward-backward direction with a rotation shaft as a fulcrum at the time of movement of a damper hinge 3A to enable an opening and closing movement of the first fluid passage 401, 401. In this manner, as shown in FIG. 30A and FIG. 30B, the arc-shaped grooves 45*a*, 45*b* are formed on a surface portion 42*b* of the valve member 42, and the first fluid passage 401, 401 are formed between the fluid guide groove portions 42*g*, 42*g* and the locking ridges 60*b*, 60*b* fitted into the fluid guide groove portions 42*g*, 42*g*. Reference will be made to the above movement below.

Next, reference is made to an assembly procedure of a damper hinge 3A according to the invention. Here, reference is made following the working procedure, in which a link shaft 46 is built into a cylinder case 40, then a rotation shaft 44 is built into the cylinder case 40.

Then, for integrating a link shaft 46 into a torsion housing chamber 40B of a cylinder case 40, the link shaft 46 is inserted into a torsion spring 47 of a torsion damper mechanism 43B from an open end side of the torsion housing chamber 40B, and its one end portion 47*a* is inserted into and locked by a locking groove 60*d* provided on a small diameter cylindrical portion 60*e* of a partition wall 60. Next, a second sealing member 27 consisting of an O-ring is mounted to a first shaft supporting portion 46*b* of the link shaft 46, and inserted from its attaching deformed shaft portion 46*a* through the torsion spring 47 into the torsion housing chamber 40B of the cylinder case 40, and the attaching deformed shaft portion 46*a* is inserted into a deformed coupling hole 44*i* provided on a rotation shaft 44; then, the first shaft supporting portion 46*b* is borne by a second bearing hole 42*a* of a valve member 42 and a first bearing hole 60*a* of the partition wall 60 and thus rotatably mounted thereto. Next, the other end portion 47*b* of the torsion spring 47 is locked by a locking groove 46*f* of a second shaft supporting portion 46*d*, and thus a second cap 62 is fitted into a second attaching hole 40*b*; then, the second shaft supporting portion 46*d* is borne by its bearing hole 62*a*, and thus pressed into second cap attaching hole portions 40*d*, 40*d* and attaching holes 62*b*, 62*b* using spring pins 63*b*, 63*b*. In this manner, the link shaft 46 is sealed by a second sealing member 50 against a fluid housing chamber 40A to rotate together with the rotation shaft 44, and mounted in the torsion housing chamber 40B in water-tight state against the torsion housing chamber 40B and the outside, while a torsion damper mechanism 43B of the link shaft 46 is composed of the torsion spring 47.

Next, for integrating a rotation shaft 44, after a required amount of fluid oil 51 is injected into a fluid housing chamber 40A, with a sealing member 49 such as O-ring being attached to an outer circumference of a large diameter portion 44*c* of the rotation shaft 44, it is inserted from the side of blade portions 44*g*, 44*h* into the fluid housing chamber 40A. Then, as the flange portion 44*d* and the blade portions 44*g*, 44*h* have all an outer diameter of the same size as an direction diameter of a cylinder case 40, the rotation shaft is inserted coaxially with the cylinder case 40. Next, a first cap 61 is fitted into a first attaching hole portion 40*a* of the cylinder case 40, with an axial supporting portion 44*b* of the rotation shaft 44 being inserted into its first bearing hole 61*a*; then, since the first attaching hole portion 40*a* is a stepped hole as shown in FIG. 20, the first cap 61 is mounted into the cap attaching hole portion 2*f* on an open end side of the cylinder case 40, without entering too much inside. At the same time, an area of a flange portion 44*d* of the rotation shaft 44 is pressed by the first cap 61, so that the side of a medium diameter portion 44*e* provided with the blade portions 44*g*, 44*h* of the rotation shaft 44 is in press contact with a surface portion 42*b* of a valve member 42 in order to be able to prevent oil leakage during the operation.

Here, a sealing member 49 is deformed to assist a press contact state. Next, a first cap 61 is fixed to a cylinder case 40 using spring pins 63*a*, 63*a*. If it is fixed in this manner, the cylinder case 40 and a rotation shaft 44 are sealed in water-tight state by a sealing member 49, with an attaching deformed shaft portion 44*a* protruding outside from the cylinder case 40, especially as shown in FIG. 20. Then, especially as shown in FIGS. 20, 30A to 30D, a first fluid chamber 40C and a second fluid chamber 40D partitioned by a valve member 42, a flange portion 44*d*, and a pair of blade portions 44*g*, 44*h* are formed in the fluid housing chamber 40A of the cylinder case 40, wherein these fluid chambers are filled with fluid oil 51 in the inside. In this manner, a fluid damper mechanism 43A is structured on the rotation shaft 44 side.

Next, reference is made to an operation of the damper hinge 3A. In Embodiment 3, reference is made only to the damper hinge 3A, but the other damper hinge (not shown) of an identical structure is used as well. Reference is made in the following to the operation of the only one damper hinge 3A. The damper hinge 3A performs the closing operation for closing the seat lid 103 from the opened position shown in FIG. 30A to the closed position shown in FIG. 30D, and inversely, the opening operation for opening the seat lid 103 from the closed position shown in FIG. 30D to the opened position shown in FIG. 30A.

For closing the seat lid 103 from the fully opened position, the fluid guide grooves 40*g*, 40*g* are closed, so that the passage for the fluid oil 51, 51 via the first fluid passage 401, 401 which is formed by the fluid guide grooves 40*g*, 40*g* is not formed, but the fluid oil 51, 51 circulates via the second fluid passage 40*m*, 40*m* and the third fluid passage 40*n*, 40*n* formed by the gap generated between the outer diameter of the medium diameter portion 44*e*, 44*e* and the inner bottom portion of the valve piece portion 42*c*, 42*d*; therefore, the seat lid 103 is closed with a small operation force, however, since the repulsive force of the torsion damper mechanism 43B increases from a half way, the seat is not suddenly, but slowly closed.

Next, reference is made in more detail to the opening of the seat lid 103 from the fully closed state shown in FIG. 30A. In the fully closed state of the seat lid 103, the blade portion 44*g*, 44*h* is at the start end of the arc-shaped grooves 45*a*, 45*b* and located on one lateral portion side of the valve piece portion 42*c*, 42*d*. The arc-shaped groove 45*a*, 45*b* is opened at this point, as shown in the drawings. When the user closes the seat lid 103 using his/her own hands from the fully opened position, the rotation shaft 44 and the link shaft 46 rotate clockwise in the drawings. First, the arc-shaped groove 45*a*, 45*b* is closed as is pressed by the fluid oil 51, 51, but the fluid oil 51 in the first fluid chamber 40C and the second fluid chamber 40D is made via the blade portion 44*g*, 44*h* to move from one of the first fluid chamber 40C and the second fluid chamber 40D to the other, so that the seat lid 103 is quickly and smoothly closed.

Figure 30C:
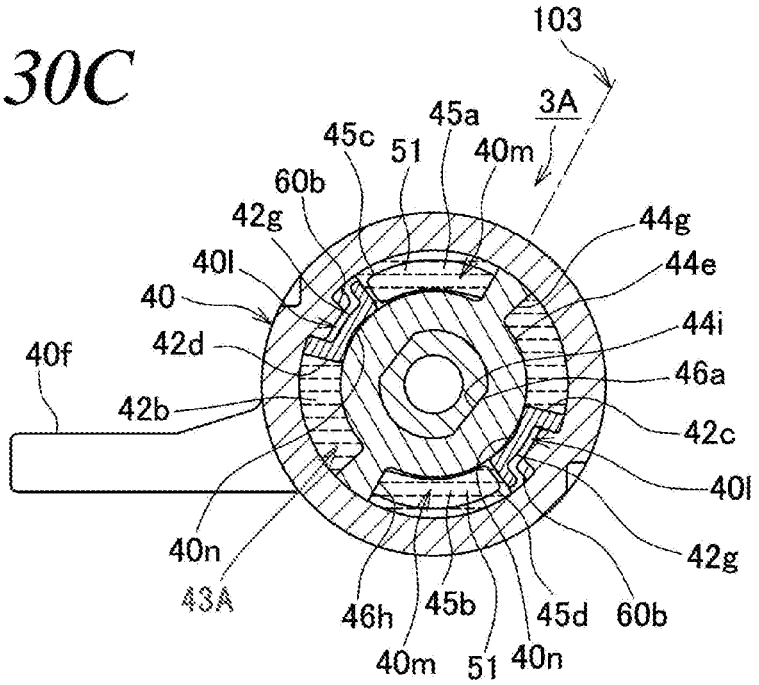
FIGS. 30C and 30D show a longitudinal cross section of a damper hinge as shown in FIG. 9, FIG. 30C being an intermediate opened state of a seat lid, and FIG. 30D—a fully closed state of a seat lid.
Figure 30D:
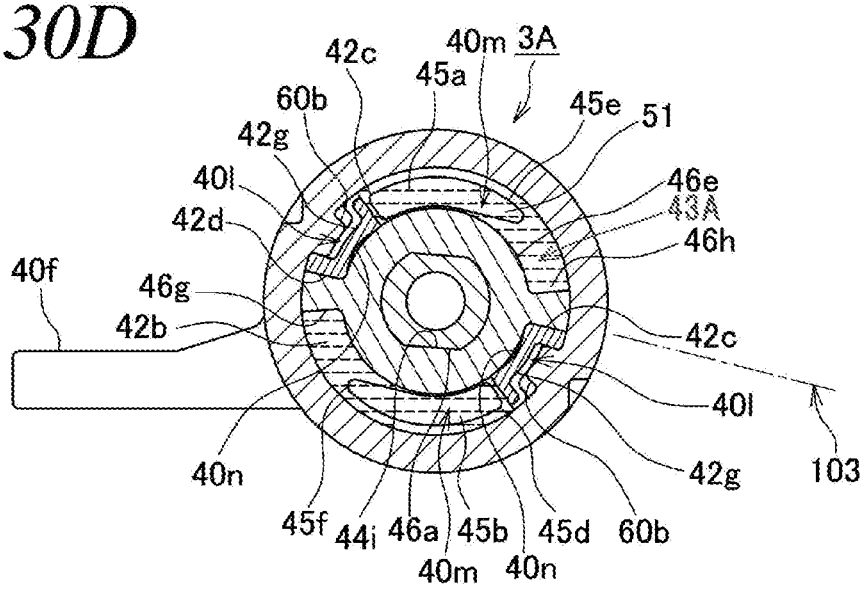

Next, when the seat lid 103 is further closed, the arc-shaped groove 45*a*, 45*b* is closed as shown in FIG. 30C, and the fluid oil 51, 51 starts to move only via the second fluid passage 40*m*, 40*m* as described above, and the elastic force of the torsion spring 47 of the torsion damper mechanism 43B is applied on the link shaft 46, so that the seat lid 103 is slowly closed to reach the fully closed state as shown in FIG. 30D.

The closed seat lid 103 can stably maintain its closed state and does not automatically rise up, even with certain oscillations or shaking from outside, since the rotation torque applied on the rotation shaft 44 via the link shaft 46 by the torsion spring 47 of the torsion damper mechanism 43B is lower than the weight of the seat lid 103 in this closed state.

Next, reference is made to the opening of the seat lid 103 from the fully closed state shown in FIG. 30D. When the seat lid 103 is fully closed, as shown in FIG. 30A, each blade portion 44*g*, 44*h* is located on the lateral portion of each valve member 42 opposed to the one shown in FIG. 30A; however, when the user holds and lifts the front side of the seat lid 103, the rotation shaft 46 starts to rotate anticlockwise to allow the opening operation of the seat lid 103. Here, the fluid 51, 51 in the first fluid chamber 40C and the second fluid chamber 40D, as is pressed by the blade portion 44*g*, 44*h*, flows in a direction opposite to that when closing the seat lid 103, and the elastic force of the torsion damper mechanism 43B is applied to assure an easy opening.

When the seat lid 103 is opened to the intermediate opening angle (60 degrees according to the embodiment), the blade portion 44*g*, 44*h* moves from the terminal end portion 45*e*, 45*f* by the further opening operation of the seat lid 103 and a rotation movement of the rotation shaft 41 is more smoothly performed due to the opened arc-shaped groove 45*a*, 45*b*, so that the elastic force of the torsion spring 28 of the torsion damper mechanism 43B start to act; in this manner, the seat lid 103 can be opened with a small operation force or even automatically to reach the fully opened state as shown in FIG. 30A.

The opened seat lid 103 can stably maintain its opened state and does not automatically close, even with oscillations or shaking from outside to a certain degree, since the blade portion 44*g*, 44*h* provided on the rotation shaft 41 abuts against the valve piece portion 42*c*, 42*d*, and the rotation torque is applied on the rotation shaft 41 in the opening direction of the seat lid 103 via the link shaft 46 by the torsion spring 47 of the torsion damper mechanism 43B in this fully opened state.

As in the foregoing, the damper hinge 3A according to the invention can provide a damper hinge with an improved operability as compared to the case of using only the fluid damper mechanism or the torsion damper mechanism, since the arc-shaped groove 45*a*, 45*b* is opened and closed from a half way, and the second fluid passage 40*m*, 40*m* operates as necessary to modify the rotation torque of the fluid damper mechanism 43A.

In the meantime, the fully opened angle for the seat lid is 120 degrees, but the invention is not limited hereto. The fully opened angle can be fittingly set. For example, for urination, the seat and the seat lid need not be opened to the fully opened position, i.e. an angle greater than 90 degrees, but can be stopped and held at 60 or 70 degrees.

Still further, the damper hinge 3A according to the invention can be installed at a position different from that of the damper hinge according to the above-described embodiment, or the damper hinge 3A can be installed in a direction opposite to that shown in FIG. 30A. In this case, the rotation torque of the seat lid 103 is different.

Still further, in Embodiments 1 to 3, it is recommended to design the damper hinge so as to form a further fluid passage between the outer circumference of the blade portions 5*f*, 5*f*; 21*f*, 21*f*; 44*g* 44*h* of the rotation shaft 5, 21, 44 and the inner circumference of the first fluid chamber 4*a*, 22*b*, 40C and the second fluid chamber 4*b*, 22*c*, 40D inside the cylinder case 2, 20, 40 in case of a strong pressure by fluid due to an abrupt operation of the seat lid 103, in order to prevent a break of the cylinder case 2, 20, 40.

Furthermore, the damper hinge as described above is used as a hinge for opening and closing the seat lid for the western-style toilet, but the invention is not limited hereto. As mentioned above, it is widely applied, when it is necessary to buffer an opening and closing body in its opening and closing, as well as when it is necessary to hold the opening and closing body in its self-standing state. For example, various opening and closing bodies for electric appliances, a cabinet, an opening and closing display body for OA equipment, etc. can be listed.

The present invention is constructed as described above, therefore, it is suitably used as a damper hinge for an opening and closing body of simple structure such as seat lid or seat for the western-style toilet, or an opening and closing body such as lid of a cabinet, wherein the opening and closing body can be opened automatically or with a small operation force, or a sudden fall can be prevented by buffering the force of the opening and closing body which is accelerated from a predetermined closing angle for closing the opening and closing body.

What is claimed is:

1. A damper hinge using a fluid damper mechanism for openably and closably attaching an opening and closing body to an opened and closed body, said fluid damper mechanism comprising a cylinder case open at one end to be attached to said opened and closed body; a plurality of locking ridges provided in an axial direction on an inner circumferential wall of a fluid housing chamber provided on said cylinder case; a valve piece engaged with each locking ridge and having a U-shaped cross section; a cap attached to said fluid housing chamber of said cylinder case; and a rotation shaft attached to said opening and closing body, said rotation shaft passing through said cap in a water-tight state and encapsulating a plurality of blade portions provided to protrude on one end portion side thereof, said fluid damper mechanism being structured, thereby a fluid passage being formed between each valve piece and said locking ridge, between an arc-shaped groove provided on a lateral wall of said cylinder case and said blade portions and between a medium diameter shaft portion of said rotation shaft with said blade portions protruding therein and said valve piece, during a rotation of said rotation shaft.

2. The damper hinge according to claim 1, an insertion regulating piece portion being provided on one side edge portion of said valve piece for regulating an insertion direction thereof.

3. A western-style toilet using a damper hinge according to claim 1.

4. A damper hinge using a fluid damper mechanism and a torsion damper mechanism for openably and closably attaching an opening and closing body to an opened and closed body, said fluid damper mechanism comprising a cylinder case open at one end to be attached to the opened and closed body, a fluid housing chamber and a torsion housing chamber being provided across a partition wall; a plurality of locking ridges provided in an axial direction on an inner circumferential wall of said fluid housing chamber provided on the cylinder case; a valve piece engaged with each locking ridge and having a U-shaped cross section; a cap attached to an open end side of the cylinder case; and a rotation shaft attached to said opening and closing body, said rotation shaft passing through said cap in a water-tight state and a plurality of blade portions being provided to protrude on one end portion side thereof, said fluid damper mechanism being structured, thereby fluid passages being formed between each valve piece and said locking ridge, between an arc-shaped groove provided on a lateral wall of said cylinder case and said blade portions and between a medium diameter shaft portion of said rotation shaft with said blade portion protruding therein and said locking ridge, during a rotation of said rotation shaft, and said torsion damper mechanism comprising a link shaft rotatably provided in the torsion housing chamber, passing through said partition wall and engaging with said rotation shaft in an axial direction in said fluid housing chamber, a cap attached to an opening end of said torsion housing chamber to pivotally supporting one end portion of the link shaft; and a torsion spring wound around said link shaft between said link shaft and said cylinder case.

5. The damper hinge according to claim 4, an insertion regulating piece portion being provided on a lateral end portion of said valve piece for regulating an insertion direction thereof.

6. The damper hinge according to claim 4, for connecting said rotation shaft and said link shaft via said partition wall, said torsion damper mechanism being first assembled, and then said rotation shaft being inserted into a first cap attaching hole portion of said fluid housing chamber, and then said link shaft being engaged and thereafter said rotation shaft being rotated to insert said blade portions into said fluid housing chamber, in order to set an initial torque to said link shaft.

7. The damper hinge according to claim 4, for connecting said rotation shaft coaxially with said link shaft, a deformed insertion portion being provided on a link shaft side, and a deformed receiving hole portion being provided on a rotation shaft side.

* * * * *